US007144200B2

(12) United States Patent
Han

(10) Patent No.: US 7,144,200 B2
(45) Date of Patent: Dec. 5, 2006

(54) INNOVATIVE PRESTRESSED SCAFFOLDING SYSTEM

(76) Inventor: Man-Yop Han, 304-1302 SK Apt., Ingye-dong, Paldal-gu, Suwon-si, Gyeonggi-do, 442-070 (KR)

( * ) Notice: Subject to any disclaimer, the term of this patent is extended or adjusted under 35 U.S.C. 154(b) by 49 days.

(21) Appl. No.: 10/530,565

(22) PCT Filed: Oct. 7, 2003

(86) PCT No.: PCT/KR03/02063

§ 371 (c)(1),
(2), (4) Date: Apr. 7, 2005

(87) PCT Pub. No.: WO2004/031510

PCT Pub. Date: Apr. 15, 2004

(65) Prior Publication Data

US 2006/0051165 A1 Mar. 9, 2006

(30) Foreign Application Priority Data

Oct. 7, 2002 (KR) ..... 10-2002-0060901
Nov. 2, 2002 (KR) ..... 10-2002-0067618

(51) Int. Cl.
*E02D 17/04* (2006.01)

(52) U.S. Cl. ..... 405/272; 405/282; 405/274; 405/275; 405/276

(58) Field of Classification Search ..... 405/272–276, 405/282
See application file for complete search history.

(56) References Cited

U.S. PATENT DOCUMENTS 3,760,594 A * 9/1973 Jurina ..... 405/267
4,372,709 A 2/1983 Krings
4,453,863 A 6/1984 Sutton et al.
5,158,398 A 10/1992 Pinho
6,616,380 B1 * 9/2003 Russell et al. ..... 405/229

FOREIGN PATENT DOCUMENTS

| | | |
|---|---|---|
| JP | 5-118036 | 5/1993 |
| JP | 8-144284 | 6/1996 |
| JP | 2000-297590 | 10/2000 |
| KR | 10-0188465 | 1/1999 |
| KR | 2000-0049712 | 8/2000 |
| KR | 20-247053 | 9/2001 |
| KR | 10-0313721 | 10/2001 |
| KR | 20-0258949 | 12/2001 |

* cited by examiner

*Primary Examiner*—Frederick L. Lagman
(74) *Attorney, Agent, or Firm*—Dickstein Shapiro LLP

(57) ABSTRACT

Disclosed herein is a support system that is temporarily placed below ground for preventing collapse of the excavated ground when a subway is constructed or a basement of a building is built. The excavated ground or load is supported by means of supporting members, the supporting members being pre-stressed by means of tensioning members and tendon support members serving to support the tensioning members. Consequently, the number of struts for supporting vertical piles and wales is considerably reduced so that obstacles in the under-ground space when it is excavated are removed. Furthermore, the constructional efficiency of the underground space is greatly improved, and the cost of construction is sharply reduced.

25 Claims, 38 Drawing Sheets

INNOVATIVE PRESTRESSED SCAFFOLDING SYSTEM

FIELD OF THE INVENTION

The present invention relates to a support system that is temporarily placed below ground for preventing the collapse of excavated ground while an underground structure is built and, more particularly, to a pre-stressed support system that is capable of pre-stressing vertical piles, wales, and/or main girders made of such as H-beams or sheet piles, with tendons, whereby the number of strut and intermediate piles is considerably reduced, thus improving the constructional efficiency and economical benefits of excavation and support operations.

BACKGROUND OF THE INVENTION

It is well known that excavation work for constructing a subway or a basement of a building is started by excavating holes along the borderline to a designed depth on the basis of technical drawings, and then vertical piles are installed into the excavated holes. After the installation of the vertical piles, excavation is partially carried out, and then main girders and cover plates are placed. After the placement of the cover plates, the additional excavation, and the placing of the wales and the supporting beams are alternately carried out. The aforementioned works are repeated in order to set up the support system in the excavated ground.

The aforementioned H-piles are usually used as the vertical piles in the support system. Alternatively, concrete may be filled into the excavated holes. Additionally, the steel piles and the concrete piles may be simultaneously used, or sheet piles may be used. And, preflex beams may be used as the vertical piles, and the H-piles may be attached to the sheet piles, to strengthen the sheet piles. However, the basic principle for supporting the excavated ground is same for the aforementioned works.

FIG. 1 is a cross-sectional view of an excavated space formed according to a conventional support system showing the arrangement of piles in the excavated space. As shown in FIG. 1, the temporary structure basically comprises: vertical piles 10 for supporting both excavated sidewalls; wales 50 for interconnecting the vertical piles 10; and struts 20 for supporting the wales 50 and the vertical piles 10. Additional intermediate piles may be placed between the vertical piles 10 when the width of the excavated space is relatively large. At the upper ends of the vertical piles 10, main girders 40 are placed, and on which cover plates 45 are securely placed so that vehicles can pass over the cover plates 45. Earth retaining plates are also inserted between the vertical piles 10 which prevent earth from collapsing between the vertical piles 10. A concrete structure 60 is built in the excavated space.

In the conventional support system, the pressure of earth and load applied to the struts 20 are repeatedly calculated to design the struts in such a manner that the struts withstand the maximum load applied to the beams when the temporary support structure is designed. As a result, a large number of struts 20 are required. In most cases, the struts 20 are closely arranged, for example, at intervals of approximately 2–3 m. The struts 20 closely arranged as described above are primary obstacles to delivering construction materials to the work place, bringing in heavy equipment and carrying out the support works. Also, the struts 20 extremely obstruct a molding work and a steel reinforcing work when the concrete structure 60 is built. For example, a plurality of holes is formed in the concrete structure 60 due to the struts 20, whereby the water-tightness and durability of the finished underground structure become severe problems.

FIG. 2 is a plan view showing a lengthy excavated space in one direction, which is supported by a conventional support system, and struts 20 arranged in the transverse direction. Generally, the struts 20 are closely arranged at intervals of approximately 2–3 m in the longitudinal direction. Between the struts are interposed, at intervals of approximately 20–30 m, bracing members 70 for preventing transverse displacement of the struts 20. As mentioned above, the struts 20 closely arranged are serious obstacles to delivering construction materials to the work place and carrying out the support works with heavy equipment.

There is an earth anchor system for supporting steel piles instead of the aforementioned struts, which is one of the support systems for constructing underground structures. According to this system, inclined holes are drilled into the ground behind the piles, tendons or high strength steel bars are inserted into the drilled holes, the ends of the inserted tendons or bars are anchored by means of a mechanical method or a chemical method, such as epoxy or cement grouting, and then the tendons or bars are tensioned and fixed to the steel piles. This system has an advantage in that the inner space of the temporary structure is very spacious, so that the earth works and the support works are easily carried out. On the other hand, this system has a disadvantage in that many of the tendons have to be placed in the neighbor's private properties when this system is applied in a crowded city, thus requires a formal consents from the neighbors. Also, the cost of construction is relatively high.

Korean Utility Model Registration No. 258949 discloses a method using truss for removing struts, which pass across the excavated space. This method is expected to be applied to the case where the depth of the excavated ground is relatively small. H-beams are doubly placed in a horizontal plane near the surface. The H-beams are reinforced with vertical beams and inclined beams so that the earth pressure is supported by truss placed at the upper part of the temporary structure. This method has been proposed to solve the difficulty in excavating and constructing the structure, which occurs due to the many support beams of the temporary structure for supporting the ground. Consequently, this method is useful for a relatively wide structure at the bottom and a relatively narrow structure at the top.

Korean Patent No. 188465 and Korean Utility Model Registration No. 247053 disclose a method for reinforcing wale by means of pre-stressing with straight tendon. In this method, an additional prestressed wale is placed on top of the existing wale so that the distance between the support beams can be increased. One method is using an additional wale, and the other method is to reinforce the existing H-beam's flange. It is expected that these two methods are effective to increase the distance between the support beams. However, because the tendons are straight, a constant support bending moment exists only in the middle part of the beam, which is different from the moment induced by the earth pressure. The different shape of the two moments restricts the length of the wale short.

SUMMARY OF THE INVENTION

The present invention has been made in view of the above problems, and it is an object of the present invention to provide a pre-stressed support system that is capable of considerably increasing the length of the wale and reducing the number of support beams, whereby an underground construction space is easily obtainable, and thus the cost of construction is dramatically reduced, and the safety and efficiency of construction works are significantly increased.

In accordance with the present invention, the above and more objects can be accomplished by the support system pre-stressed with tendons and tendon support members for supporting the excavated ground, Preferably, the pre-stressed support systems are wales or vertical piles for supporting the excavated ground, or main girder for withstanding the service load. The pre-stressed support systems are H piles, steel or concrete piles having circular, square or any other sections. The tensioning members can be made of tendons, high tensile bars, carbon fibers, glass fibers, aramid fibers and/or etc.

Preferably, each of the pre-stressed support system comprises: a first tendon support disposed at the middle part of each wale, and second and third tendon supports disposed at both sides of the first tendon support such that the heights of the second and third tendon supports are lower than that of the first tendon support, wherein the tendons are placed on the first, second, and third tendon supports.

BRIEF DESCRIPTION OF THE DRAWINGS

The above and more objects, features and other advantages of the present invention will be more clearly understood from the following detailed description taken in conjunction with the accompanying drawings, in which.

DETAILED DESCRIPTION OF THE PREFERRED EMBODIMENTS

The preferred embodiments of the present invention will now be described with reference to the accompanying drawings.

Figure 3:
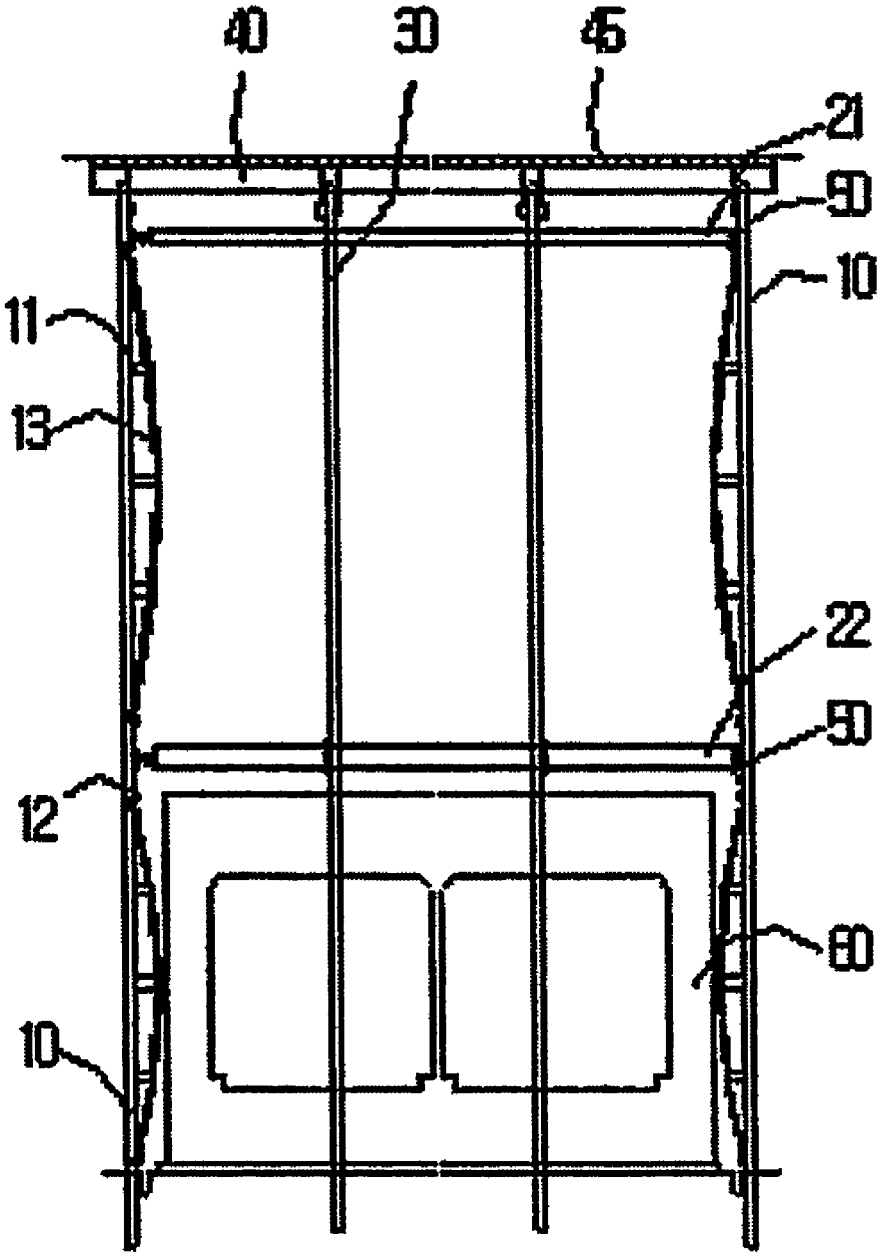
FIG. 3 is a cross sectional view showing vertical piles disposed in the entire excavated space pre-stressed by means of the tendons, the tendon supports, and the anchoring units according to a first preferred embodiment of the present invention.

FIG. 3 is a cross sectional view showing vertical piles disposed in the entire excavated space pre-stressed by means of tendons, tendon suppports, and anchoring units according to a first preferred embodiment of the present invention. A temporary structure, to which a pre-stressed support system according to the present invention is applied, comprises vertical piles 10, struts 21, middle piles 30, main girders 40, cover plate 45, and wale 50, which are the same as the abovementioned components of the conventional support system. In the pre-stressed support system of the present invention, however, a plurality of tendon supports 11, anchoring units 12, and tendons 13 are further attached to the vertical piles 10 so that the vertical piles 10 are pre-stressed. As a result, the vertical piles can withstand additional soil pressure although the number of the struts is considerably reduced. Of course, the magnitude of load applied to the struts 21 and 22 is increased as the number of the struts is decreased. Consequently, it is required that struts having increased dimensions be used under the condition that the number of the struts is decreased. It is possible that the dimensions of the struts 21 and 22 used in the pre-stressed support system of the present invention are larger than those of the struts used in the conventional support system.

The size and the shape of a concrete structure 60 to be built in the excavated space are also shown It is possible to install the struts 21 and 22 without interfering the structure to be built. Consequently, rebar works or formworks can be easily and conveniently carried out while the underground structure is built. Also, large-sized heavy equipments can be easily brought in and operated in the excavated space. Furthermore, no holes are formed in the built structure 60, thus increasing the durability of the structure.

As shown in FIG. 3, pre-stressing is applied at two stages since the depth of the excavated space is large. It is understood, however, that the pre-stressing may be applied at a single stage when the depth of the excavated space is small.

The struts 21 and 22 serve to withstand the horizontal component of the earth pressure applied through the vertical piles 10. Consequently, earth anchors (not shown) or other means may be used instead of the struts 21 and 22 in the case that the struts 21 and 22 are to be completely removed.

The support system of the present invention is primarily applied to H-type piles as shown in the drawings, although the support system of the present invention may also be applied to all kinds of vertical and horizontal reinforcing members, which are conventionally used to support the excavated surfaces, such as steel piles having circular or square sections or concrete piles having circular or square sections.

Figure 4:
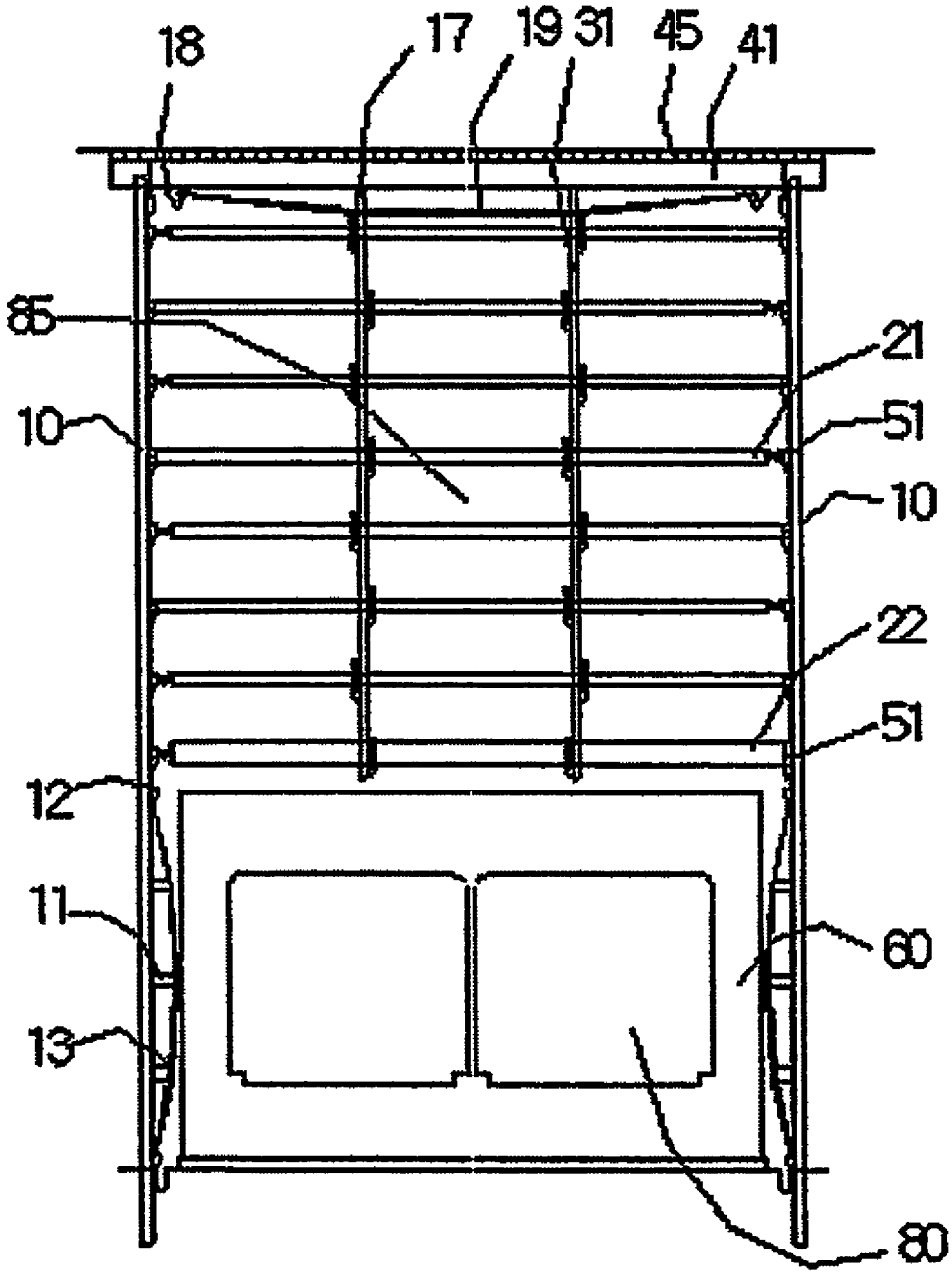
FIG. 4 is a cross sectional view showing vertical piles disposed at the lower part of the excavated space pre-stressed by means of the tendons, the tendon supports, and the anchoring units according to the first preferred embodiment of the present invention.

FIG. 4 is a cross sectional view showing vertical piles disposed at the lower part of the excavated space pre-stressed by means of the tendons, the tendon supports, and the anchoring units according to the first preferred embodiment of the present invention. As shown in FIG. 4, only the lower part 80 of the excavated space where the structure is to be built is pre-stressed. The plurality of struts 21 are used at the upper part 85 of the excavated space, which is the same as the conventional support system. The layout of FIG. 4 may be appropriately combined with the layout of FIG. 5, which will be described later. In this case, the layout of FIG. 4 totally withstands the load of the ground transferred from the layout of FIG. 5 when the entire ground supporting system is constructed. Consequently, the size of the respective struts 22 is increased. Also, the lower part 80 of the excavated space, where the structure 60 is to be built, may be pre-stressed on the basis of the layout of FIG. 4 in the case that the ground is constructed according to the conventional support system The layout can be easily applied to any existing construction sites. In this case, the main structure can be easily and conveniently built.

The middle piles 30 for withstanding the load from the main girders 40 are required for the conventional support system. In the present invention, however, the main girders 40 may be pre-stressed by means of tendons 19, tendon supports 17, and anchoring units 18, resulting in the removal of the middle piles 30. The main girders 41 with the middle piles 30 removed are braced to each other in the horizontal direction so that the upper temporary structure is securely supported. Consequently, the middle piles 30, which withstand the load from the main girders 40 in the conventional support system, do not withstand the vertical load any longer, and thus only serve as bracing members 31 for preventing buckling of the struts 21. As a result, formation of vertical holes in the main structure 60 is effectively prevented.

Figure 5A:
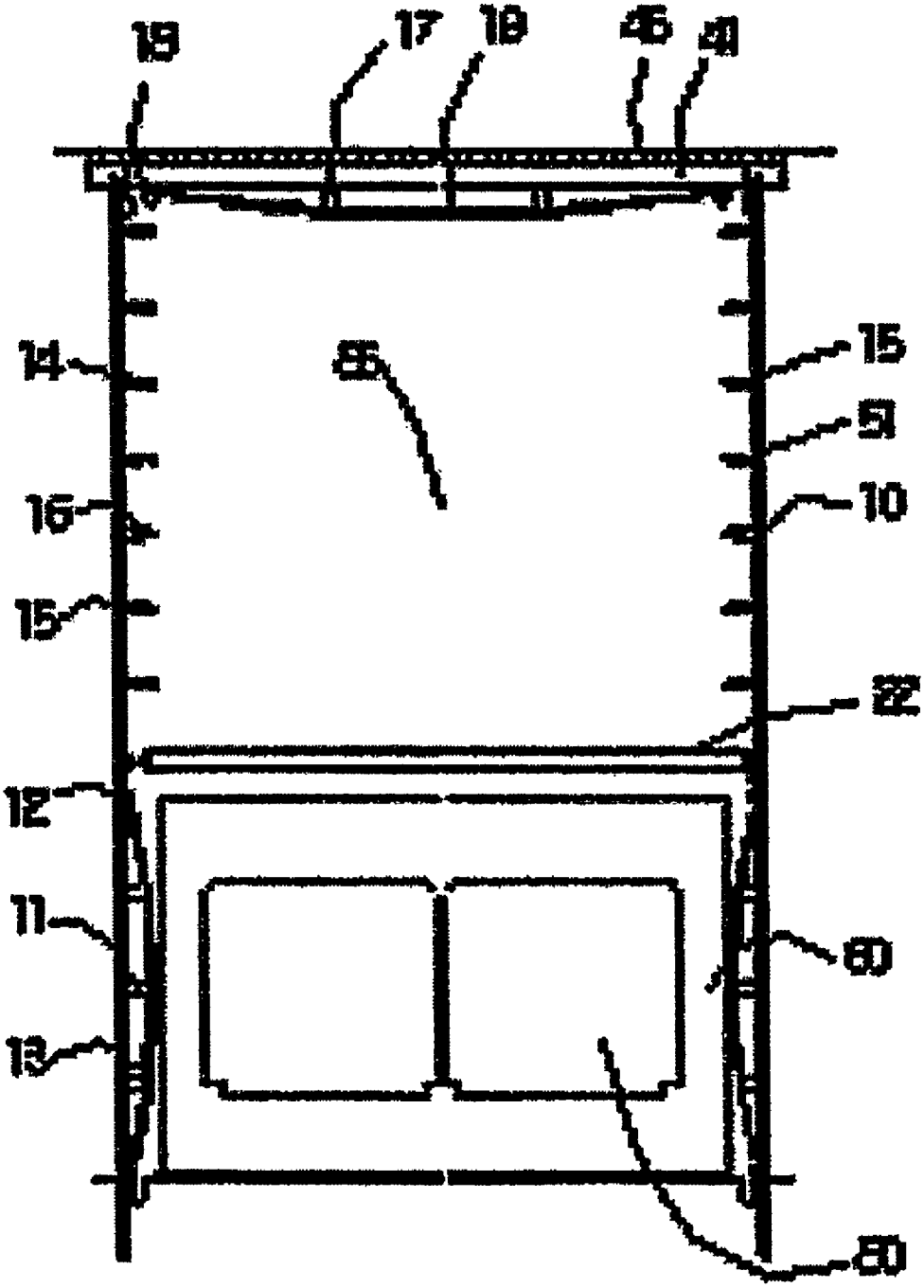
FIG. 5*a* is a cross sectional view showing the upper part of the excavated space horizontally pre-stressed and the lower part of the excavated space vertically pre-stressed by means of the tendons, the tendon supports, and the anchoring units according to the first preferred embodiment of the present invention, wherein struts are placed over a main structure.

FIG. 5*a* is a cross sectional view showing the upper part of the excavated space horizontally pre-stressed and the lower part of the excavated space vertically pre-stressed by means of the tendons, the tendon supports, and the anchoring units according to the first preferred embodiment of the present invention. As shown in FIG. 5*a*, the upper part 85 of the structure is horizontally pre-stressed, and the lower part 80 of the structure is vertically pre-stressed so that the inner excavated space is provided. Only the struts 22 passing by the upper end of the structure are used to support the horizontal force of the vertical pre-stressing. The lower part of the excavated space where the structure is to be built must be vertically pre-stressed so that generation of obstacles at the space where the structure is to be built is prevented. The upper part of the excavated space must be horizontally reinforced so that the struts 20 are removed, whereby equipment and materials necessary during the excavation and construction works can be easily and conveniently used. Above the structure is concentrated the earth pressure. Consequently, the struts 22 are placed above the structure so that the earth pressure is withstood by means of the struts 22. Reference numeral 14 indicates tendon supports, reference numeral 15 indicates anchoring units, and reference numeral 16 indicates tendons.

Figure 5B:
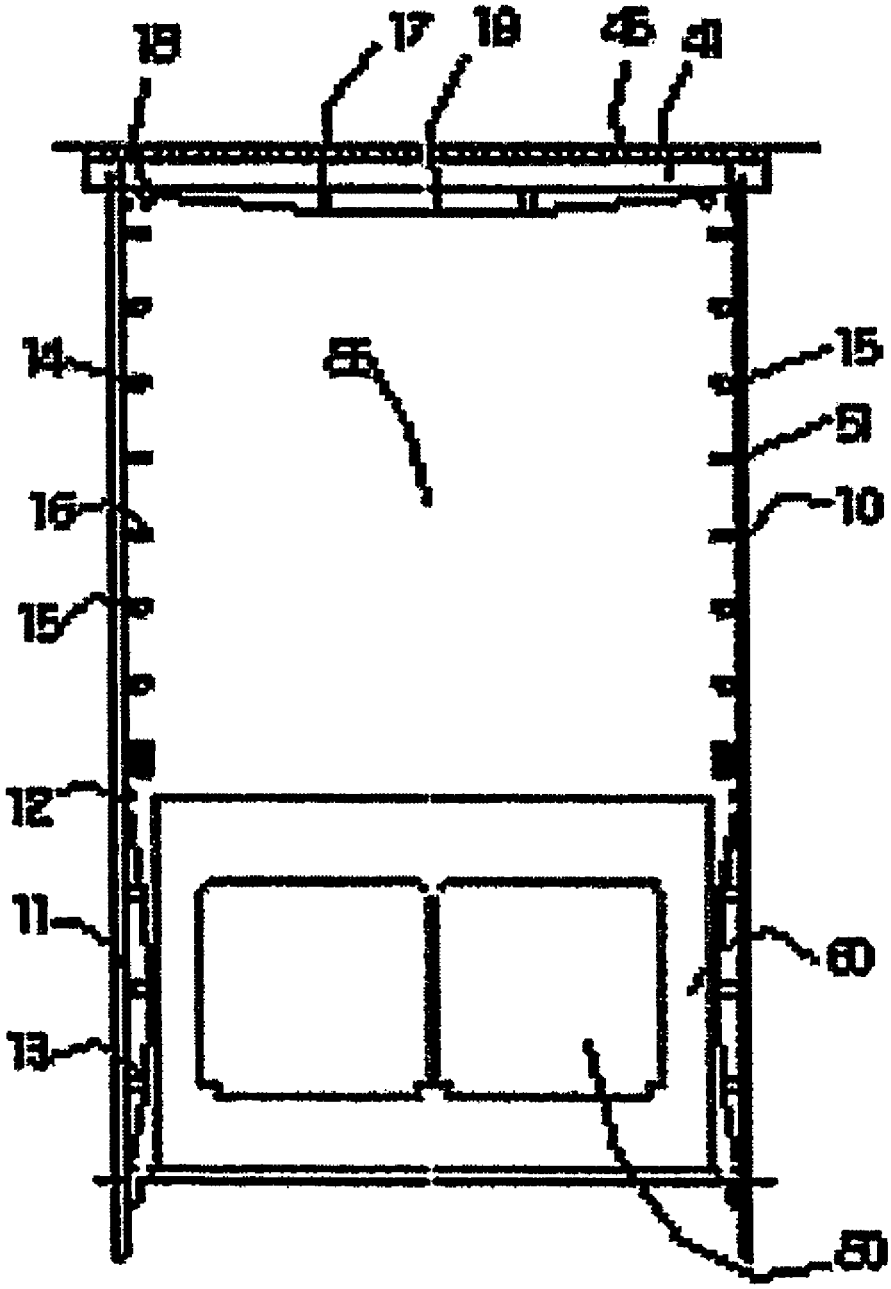
FIG. 5*b* is a cross sectional view showing the upper part of the excavated space horizontally pre-stressed and the lower part of the excavated space vertically pre-stressed by means of the tendons, the tendon supports, and the anchoring units according to the first preferred embodiment of the present invention.

FIG. 5*b* is a cross sectional view showing the upper part of the excavated space horizontally pre-stressed and the lower part of the excavated space vertically pre-stressed by means of the tendons, the tendon supports, and the anchoring units according to the first preferred embodiment of the present invention. As shown in FIG. 5*b*, the upper part 85 of the structure is horizontally pre-stressed, and the lower part 80 of the structure is vertically pre-stressed so that the inner excavated space is completely emptied. The layout of FIG. 5*b* is extremely similar to that of FIG. 5*a* with the exception of how to withstand the earth pressure concentrated above the structure 60. According to the layout of FIG. 5*a*, the earth pressure concentrated above the structure is withstood by means of the struts 22. On the other hand, horizontal pre-stressing is concentrically applied so that the concentrated earth pressure is withstood according to the layout of FIG. 5*b*. As shown in FIG. 5*b*, several pre-stressed wales 51 may be further disposed. Alternatively, the large-sized wales having the increased number of tendons as shown in FIG. 4 may be used.

Figure 1:
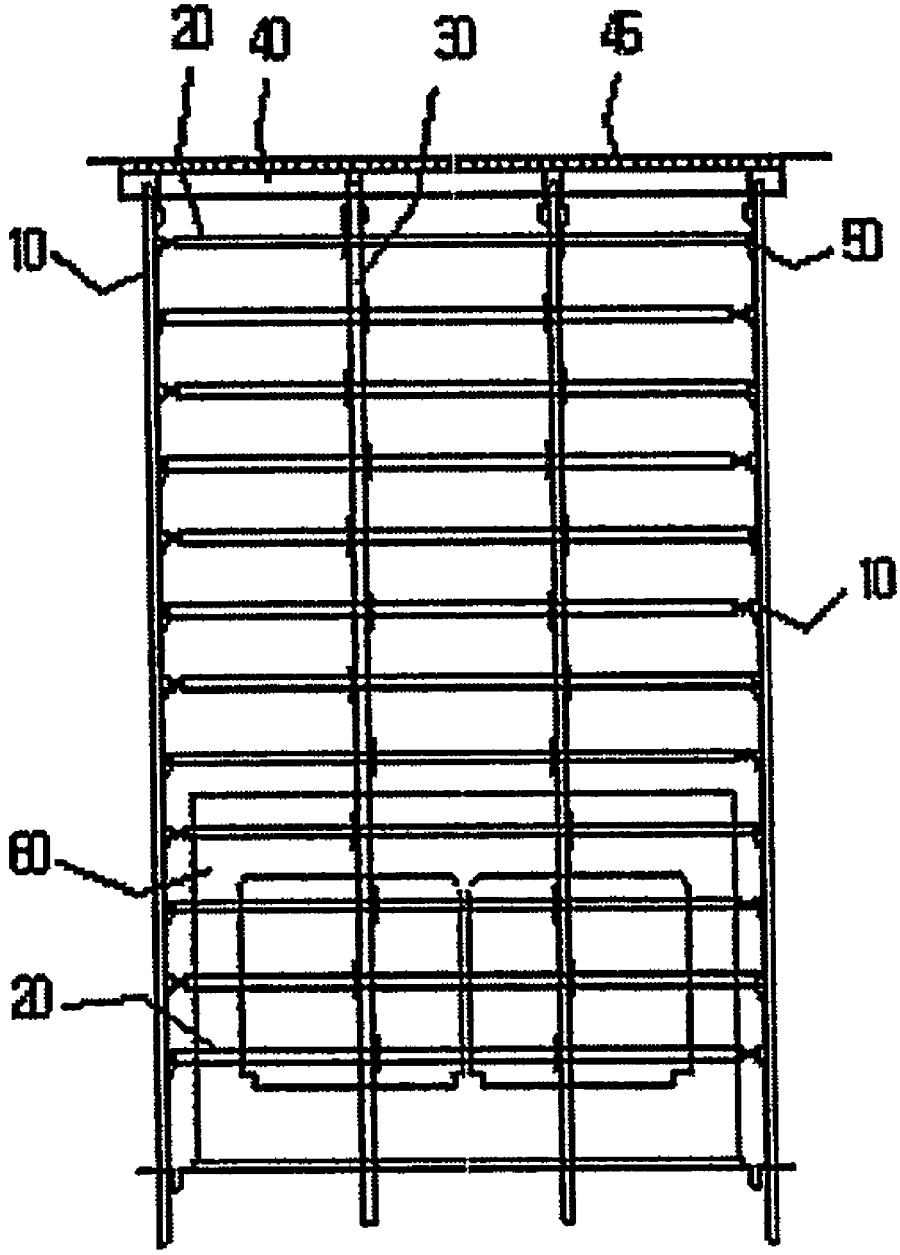
FIG. 1 is a cross sectional view of an excavated space formed according to a conventional support system showing the arrangement of support beams in the excavated space.
Figure 2:
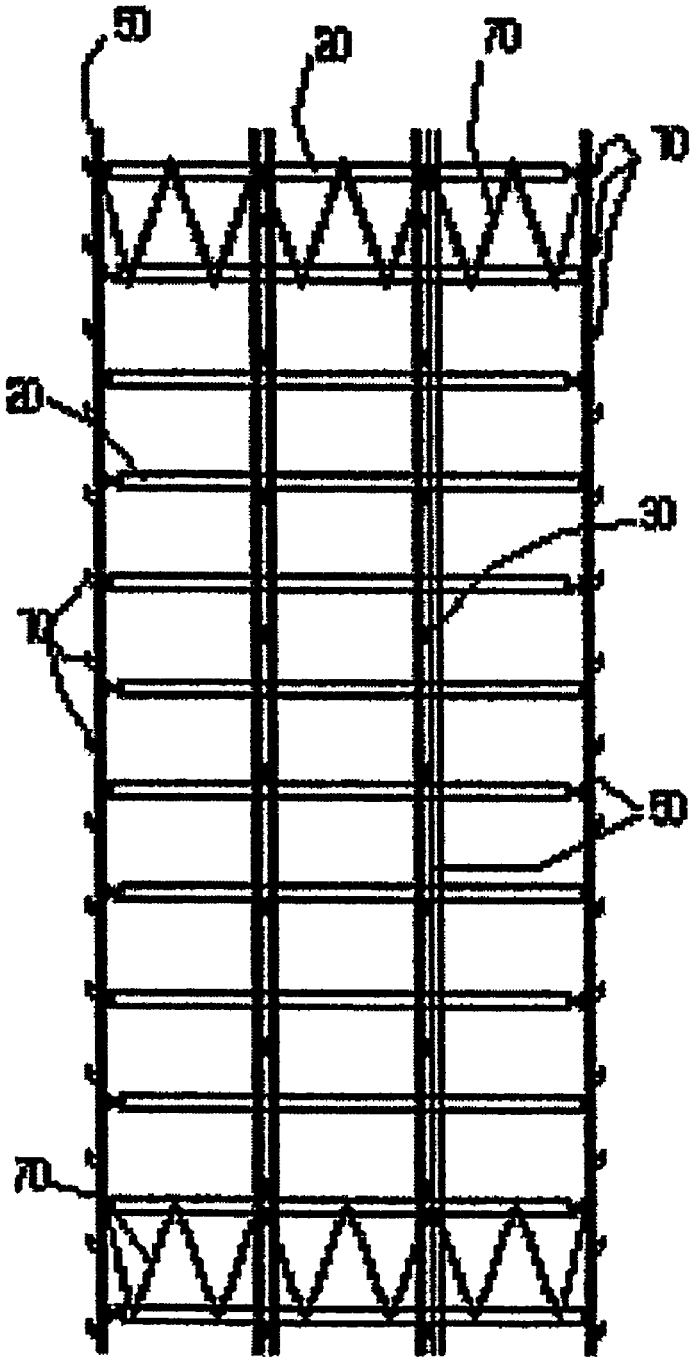
FIG. 2 is a plan view showing the arrangement of support beams according to the conventional support system.
Figure 6:
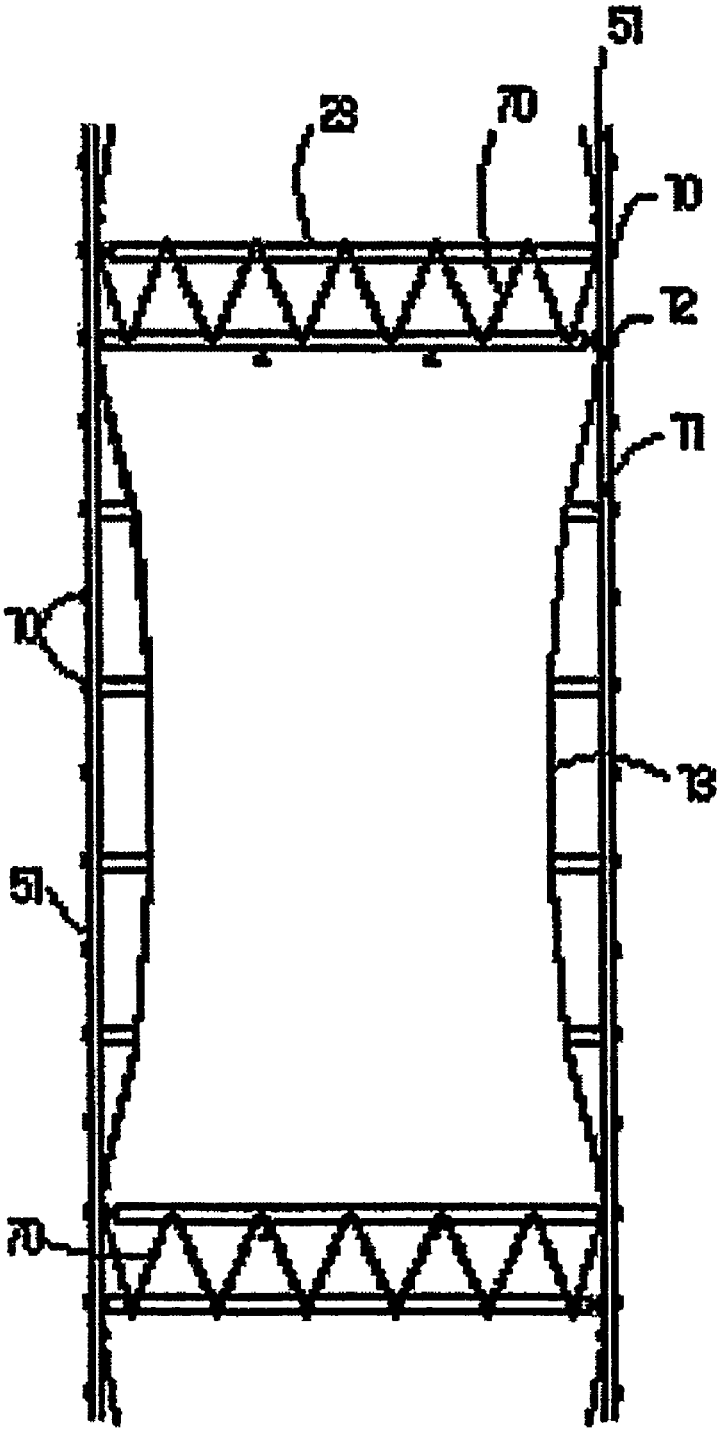
FIG. 6 is a plan view showing wales supported by means of tendons with the struts removed according to the first preferred embodiment of the present invention.

FIG. 6 is a front view illustrating how much the inner excavated space is widened when the excavation work is carried out, which solves the problems caused in the conventional support system as shown in FIG. 2. As shown in FIG. 6, all of the conventional struts 20, which are disposed between the struts 23 sustained by means of the bracing members 70, are removed, and the plurality of tendon supports 11, anchoring units 12, and the tendons 13 are further attached to the wales 51 between the remaining struts 23 so that the wales 51 are pre-stressed. Consequently, the earth pressure is further withstood by means of the pre-stressed wales 51, whereby the distance between the struts can be increased. As shown in FIG. 6, positions of the tendon supports 11 correspond to those of the vertical piles 10, to which the earth pressure is directly applied, so that the bending moment is not applied to the wales 51. In this case, the length of the respective wales 51 is further increased. As shown in FIG. 6, the distance between the struts 23 is increased so that the construction materials and large-sized heavy equipments can be easily brought in and out, construction works in the underground space can be easily carried out, and steel reinforcing works or molding works, which are required to build the main structure, can be easily and conveniently carried out Also, only the ruts 23 sustained by means of the bracing members 70 are used with the intermediate struts removed, whereby the horizontal buckling of the struts is prevented.

Figure 7:
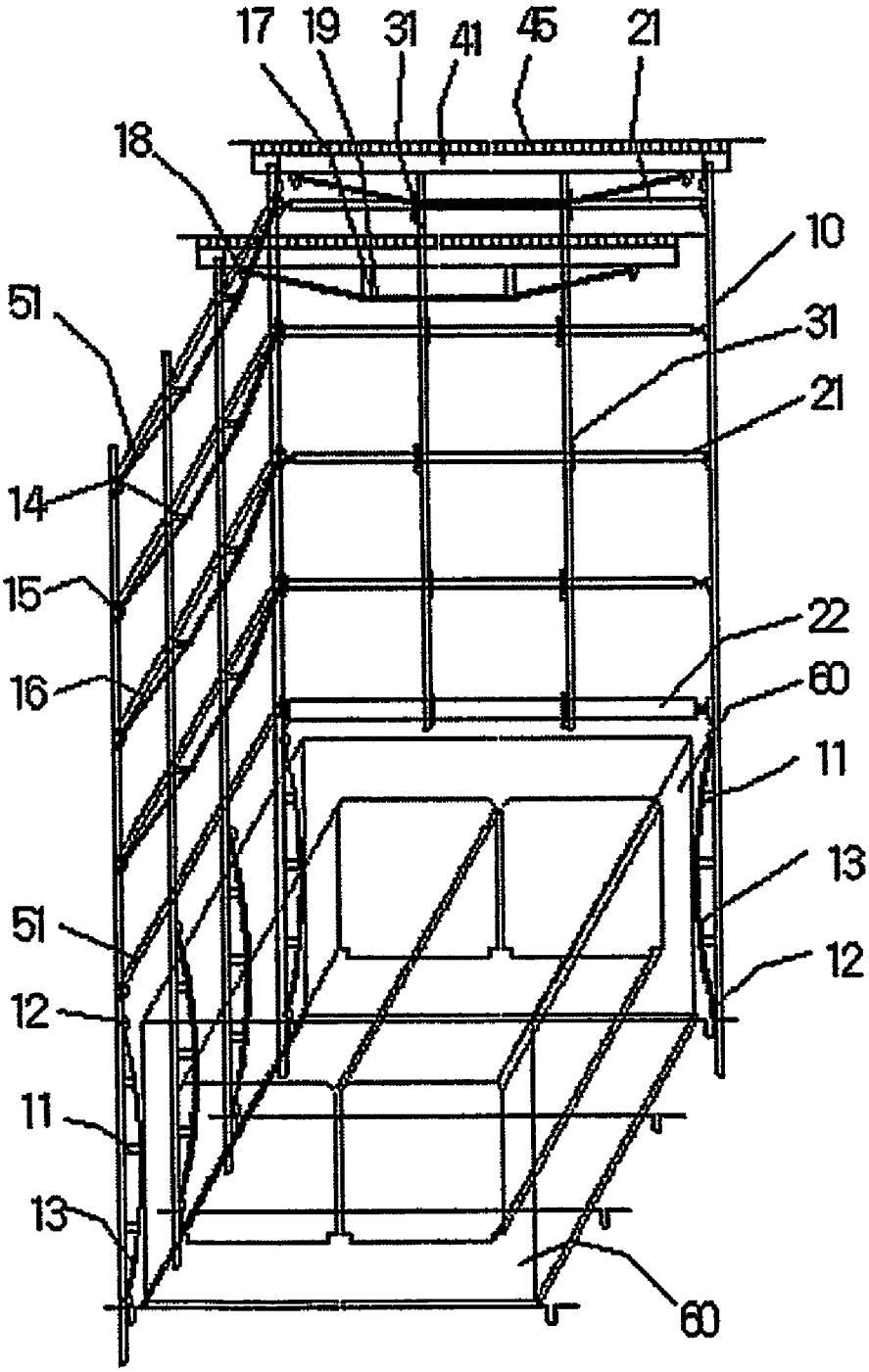
FIG. 7 is a perspective view showing a wide working space formed in the underground space by means of an appropriate combination of the layouts of FIGS. 4 and 5.

FIG. 7 is a perspective view showing a wide working space formed at the underground space by means of an appropriate combination of the layouts of FIGS. 4 and 5. As shown in FIG. 7, the excavation of the underground space is completed while the vertical piles 10 and the wales 51 are pre-stressed. The wales 51 are pre-stressed so that the upper part of the excavated space is reinforced. The vertical piles 10 are vertically pre-stressed so that the lower part of the excavated space where the structure is to be built is reinforced. The earth pressure, which is transmitted to the struts 21, applied to the anchored parts of the vertical piles 10, to which the vertical pre-stressing is anchored, is larger than that applied to other parts. Consequently, a large number of tendons are required so that pre-stressing larger than the pre-stressing of other wales 51 disposed at the upper part of the excavated space can be applied.

The larger earth pressure is concentrated at the strut 22 disposed at the lowest part of the excavated space rather than at struts 21. Consequently, a strut 22 having a large section is required. As shown in FIG. 7, the vertical piles 10 and the wales 51 are reinforced by means of the pre-stressing tendons 13 and 16 at the excavated sidewalls. All of the earth pressure, which is applied to the part of FIG. 5 with the struts removed, is withstood by means of the layout of FIG. 4, in which several struts 21 and 22 are arranged at prescribed intervals. In the support system for supporting the excavated ground according to this preferred embodiment of the present invention, withstanding the earth pressure by means of applying the pre-stressing using the tendons as mentioned above is the most efficient. In some cases, however, the vertical piles 10 or the wales 51 may be reinforced by means of reinforcing members, such as H-type beams (not shown), preflexed beams (not shown), complex beams (not shown), or trusses (not shown), which provides a similar effect.

Figure 8A:
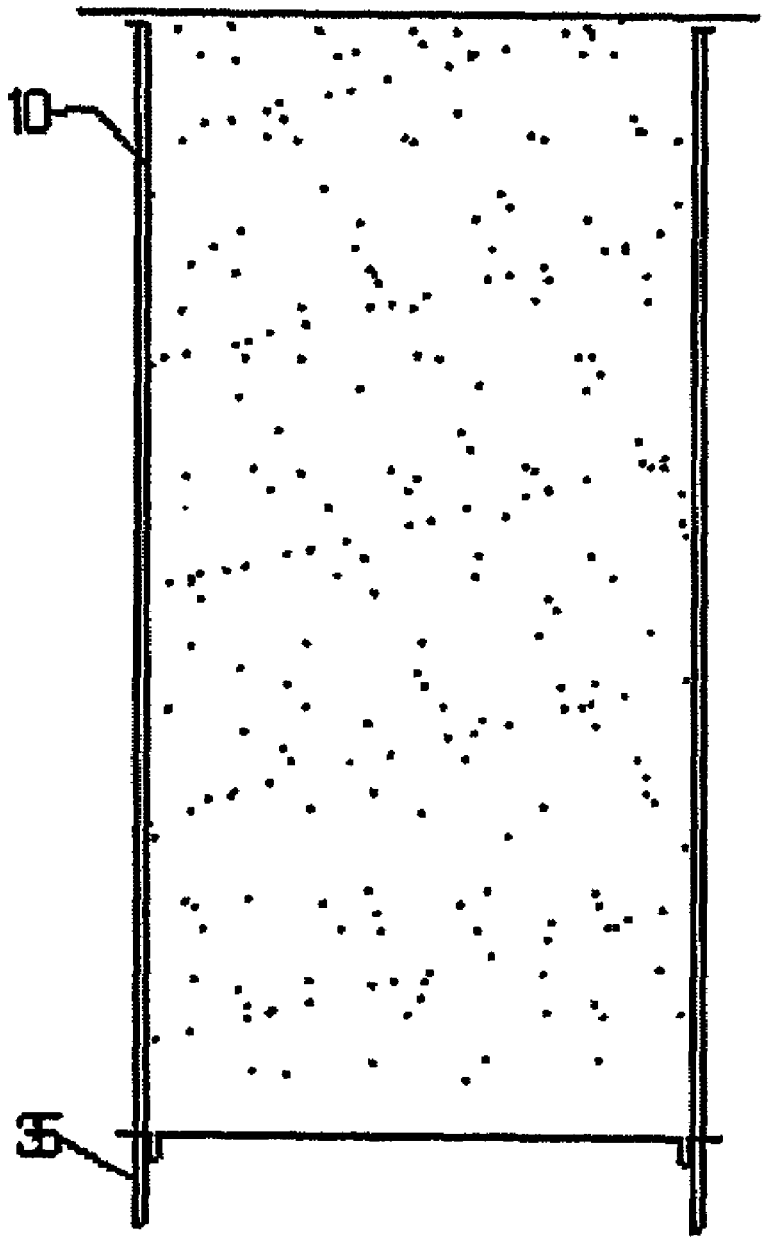
FIG. 8*a* is a cross sectional view showing the installation of vertical piles prior to excavating process according to the first preferred embodiment of the present invention.

FIGS. 8*a* to 8*d* illustrate, in sections, the process for constructing the temporary structure. FIG. 8*a* shows the installation of a vertical pile 10 prior to an excavating process according to the first preferred embodiment of the present invention. The hole is drilled at the designed position, and then the vertical pile 10, or the intermediate pile, if necessary, is installed into the drilled hole. When the pile is installed, a hardening material or a ground reinforcing material, such as concrete, may be supplied to the lower base part 35 of the pile so that the pile is reinforced. Alternatively, the pile may be made of concrete or other hardening materials.

Figure 8B:
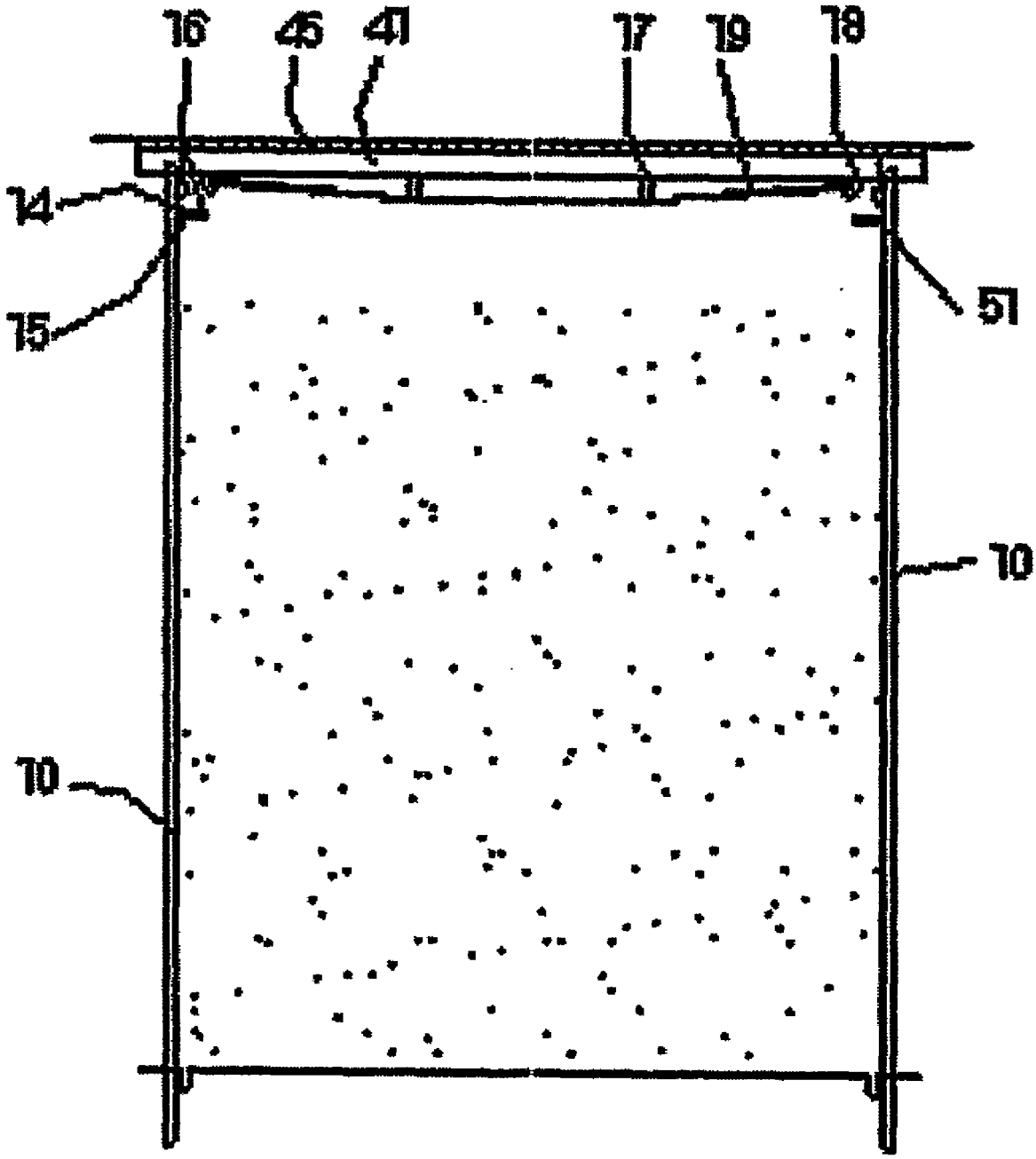
FIG. 8*b* is a cross sectional view showing an early step of the excavating process according to the first preferred embodiment of the present invention.

FIG. 8*b* shows an early step of the excavating process according to the first preferred embodiment of the present invention. On the vertical piles 10 are disposed main girders 41 and the cover plates 45. In this case, the main girders 41 are pre-stressed so that intermediate piles (not shown) are completely removed. Although the pre-stressed main girders 41 are used in this embodiment, the main girders 41 may be pre-stressed later, which has the same effect as the pre-stressed main girders. Consequently, the main girders may be easily reinforced in any existing construction sites.

Figure 8C:
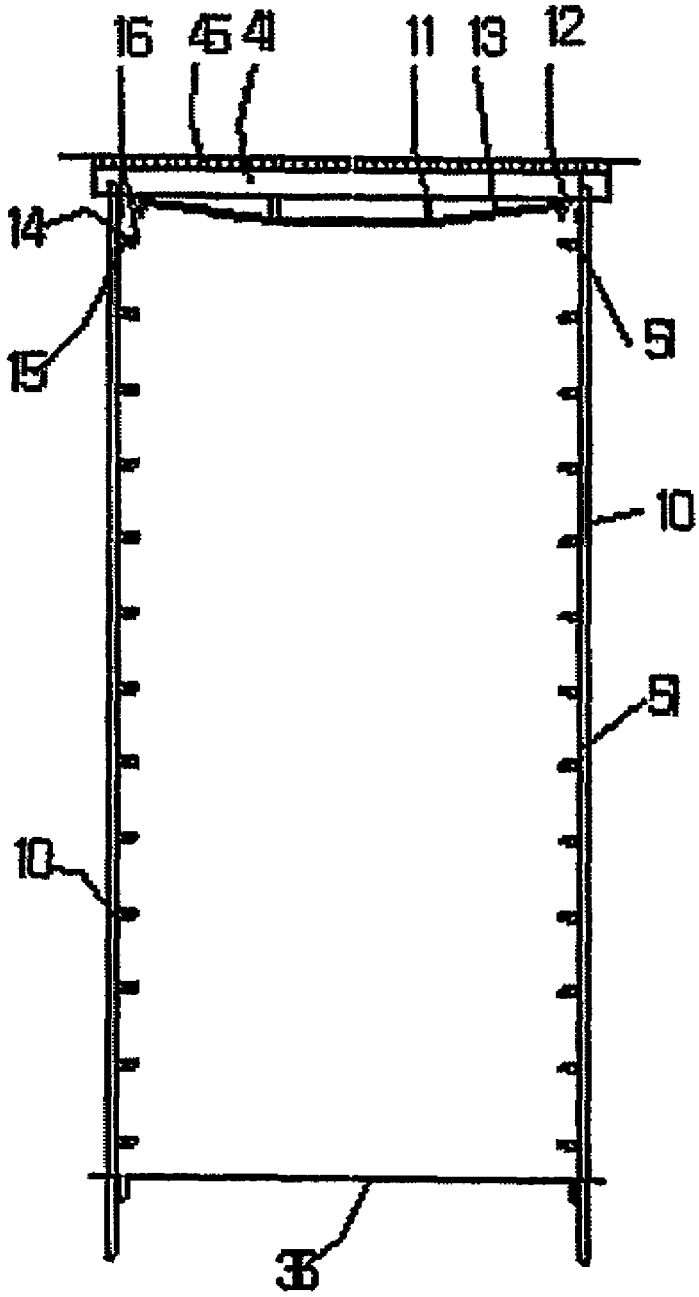
FIG. 8*c* is a cross sectional view showing the completion of the excavating process according to the first preferred embodiment of the present invention.

FIG. 8*c* shows the excavating process of the support system according to the first preferred embodiment of the present invention In the conventional support system, the ground is excavated to a prescribed depth, struts 20 are installed, the excavation work is further carried out after the struts are installed, and other struts are installed after the ground is further excavated, which are repeated until the ground is excavated to a designed depth 36. At this time, the excavation works are delayed due to the closely arranged struts 20. On the other hand, the excavated sidewalls are supported by means of the pre-stressed wales 51 according to the excavation works of the present invention. As a result, the excavation works are carried out while the struts, which obstruct the excavation works, are not present. Consequently, the excavation works can be easily and quickly carried out.

Figure 8D:
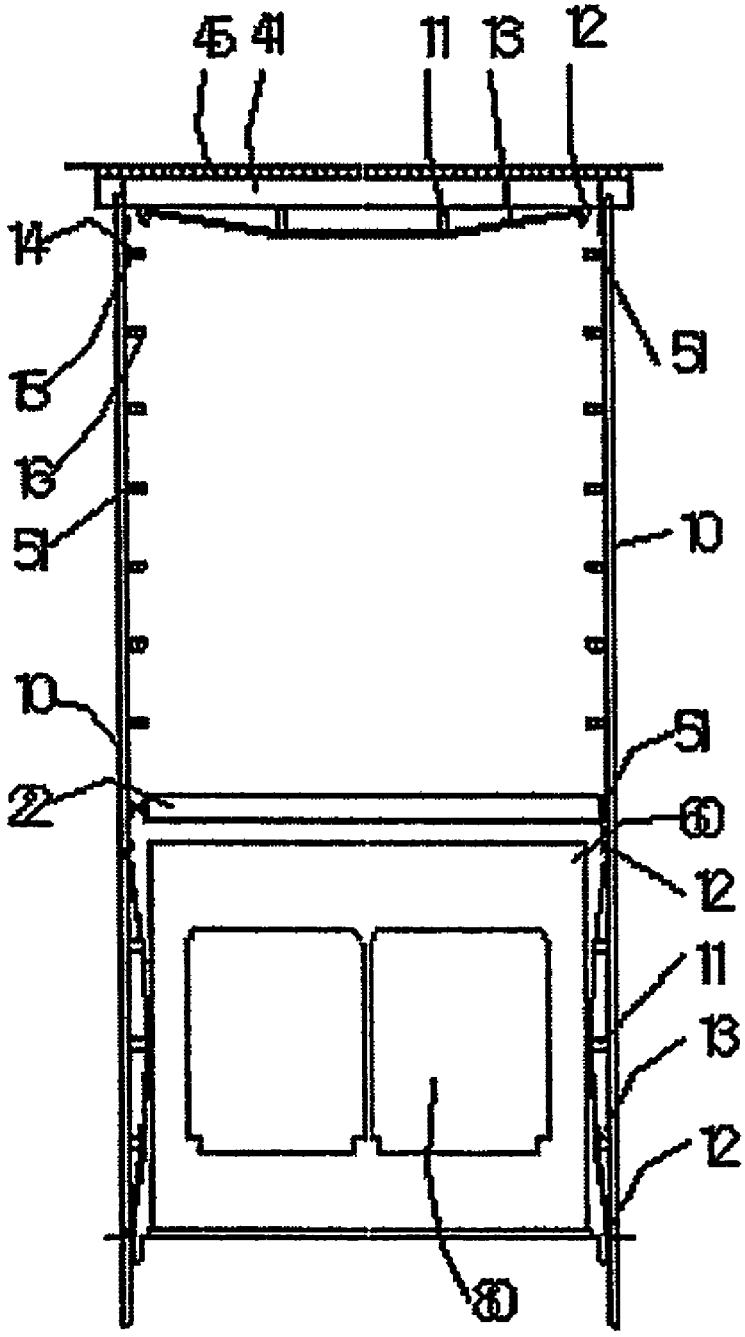
FIG. 8*d* is a cross sectional view showing the completion of a temporary support according to the first preferred embodiment of the present invention.

FIG. 8*d* shows the last step of the excavating process according to the first preferred embodiment of the present invention. As shown in FIG. 8*d*, the strut 22 is placed at the upper part of the excavated space where the structure is to be built, and then the lower part of the vertical piles 10 are vertically pre-stressed so that the vertical piles 10 are reinforced. After the support system of the present invention is completed, all of the struts excluding the strut 22 disposed just above the structure are removed, and the intermediate piles are completely removed. The size and the shape of the structure to be built in the upper part 80 of the temporary structure are also shown in FIG. 8*d*. According to the support system of the present invention, no struts or intermediate piles passing through the main structure 60 are provided so that the construction work of the structure is easily carried out. Furthermore, no holes are formed in the structure, whereby watertightness of the structure is perfectly guaranteed, and durability of the structure is improved.

Figure 9:
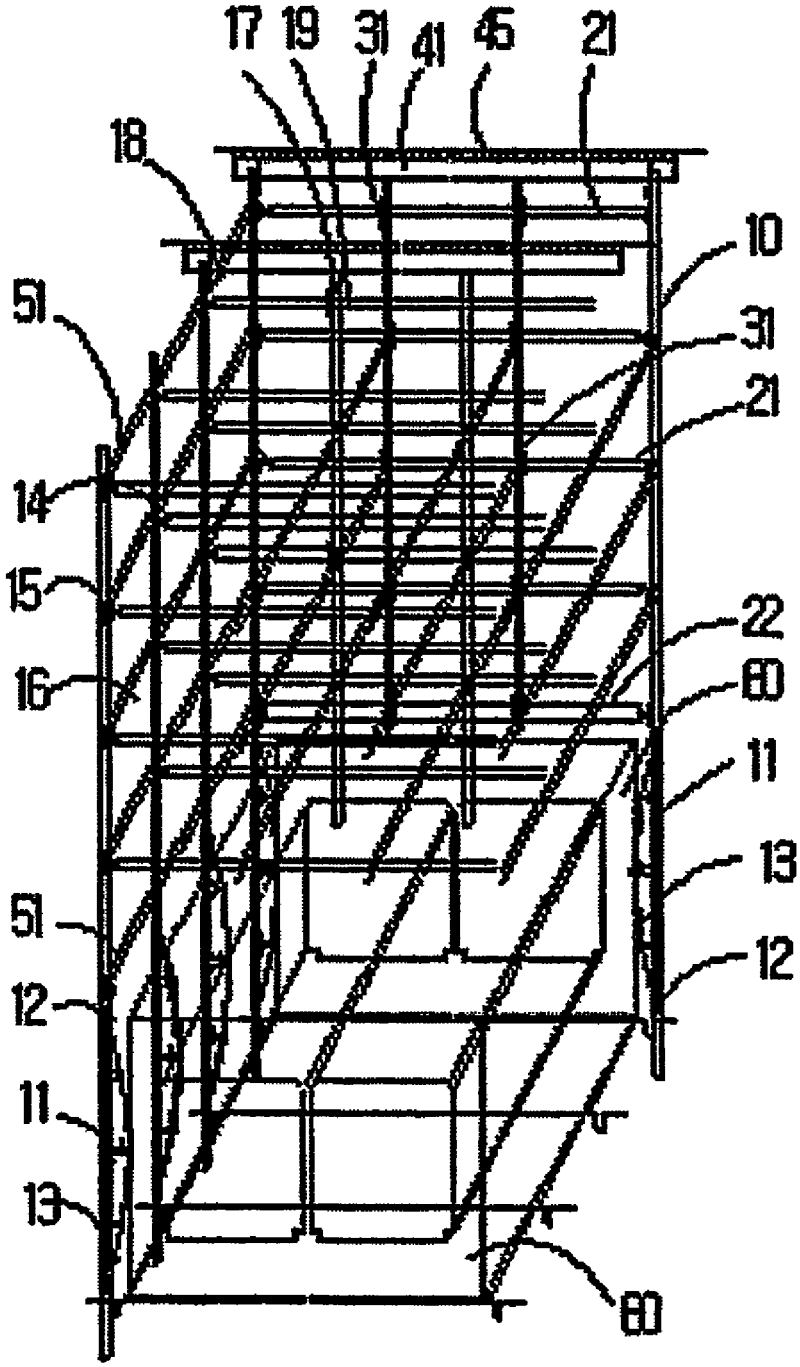
FIG. 9 is a perspective sectional view showing tendon-anchoring units and tendon support members disposed only at the lower part of the excavated space, where the main structure is to be built with the lower part of the excavated space vertically pre-stressed and the upper part of the excavation supported with conventional support system.
Figure 10:
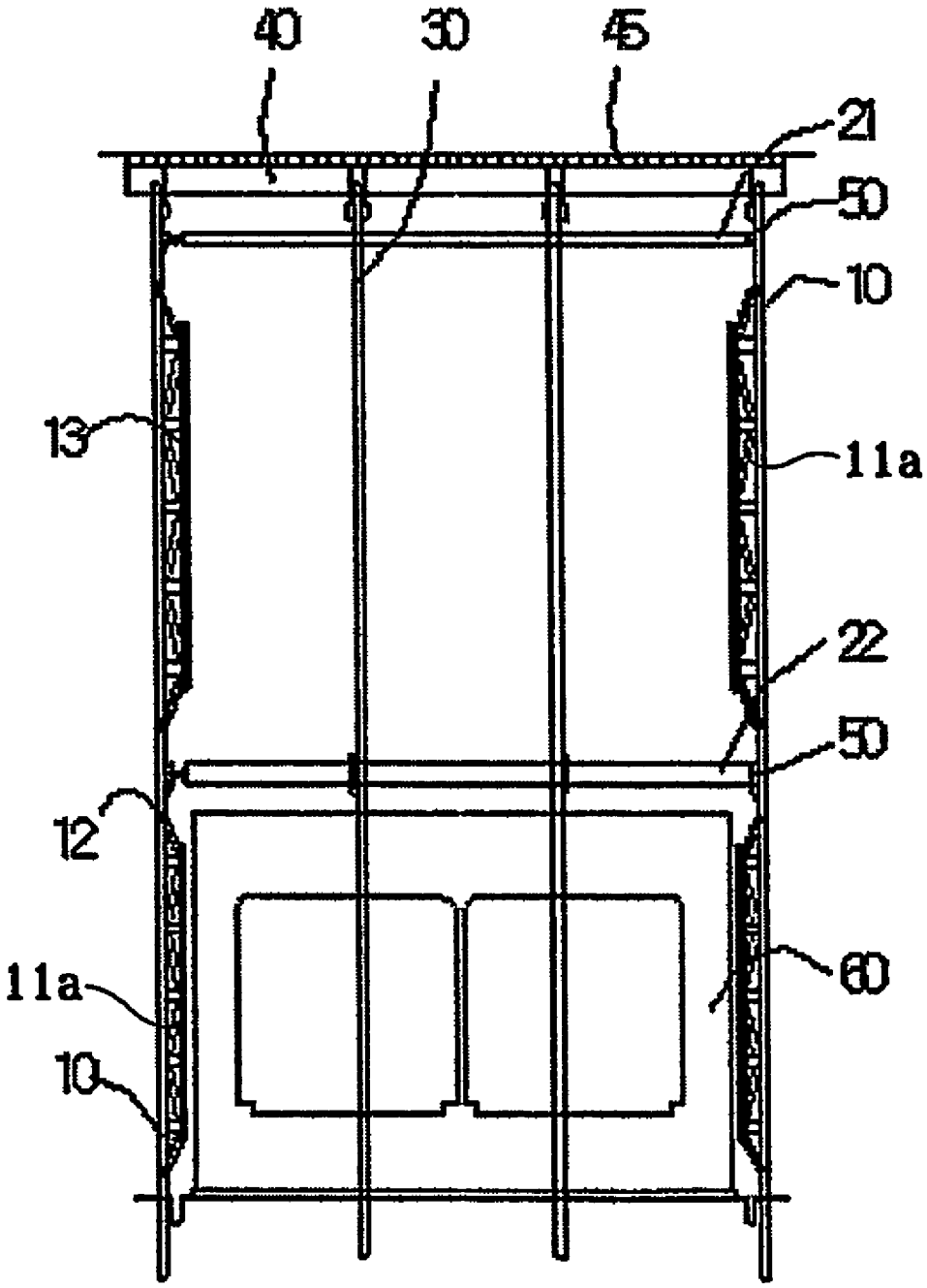
FIG. 10 is a cross sectional view showing vertical piles disposed in the entire excavated space pre-stressed by means of tendons, trusses, and anchoring units according to a second preferred embodiment of the present invention.
Figure 11:
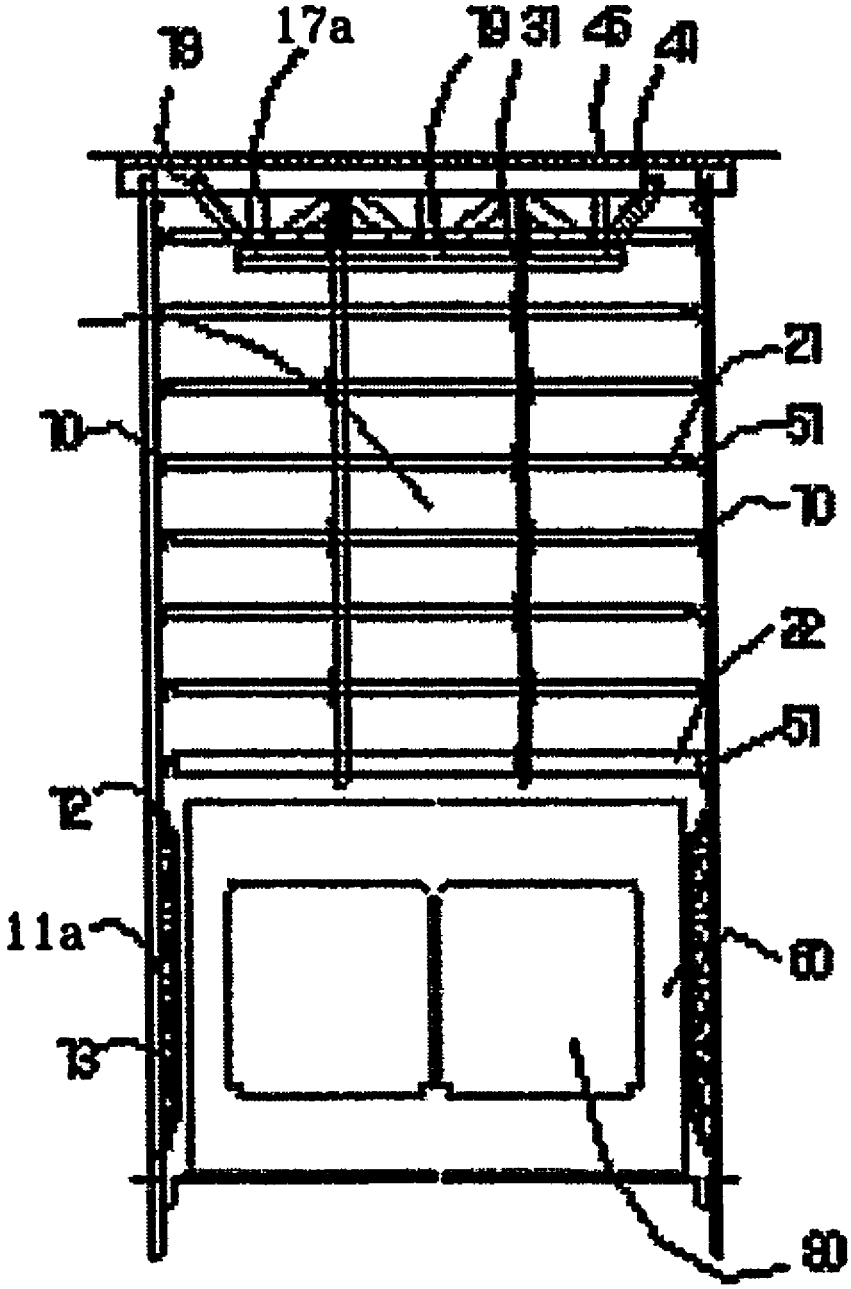
FIG. 11 is a cross sectional view showing main girder and vertical piles disposed at the lower part of the excavated space pre-stressed by means of the tendons, the trusses, and the anchoring units according to the second preferred embodiment of the present invention.
Figure 12A:
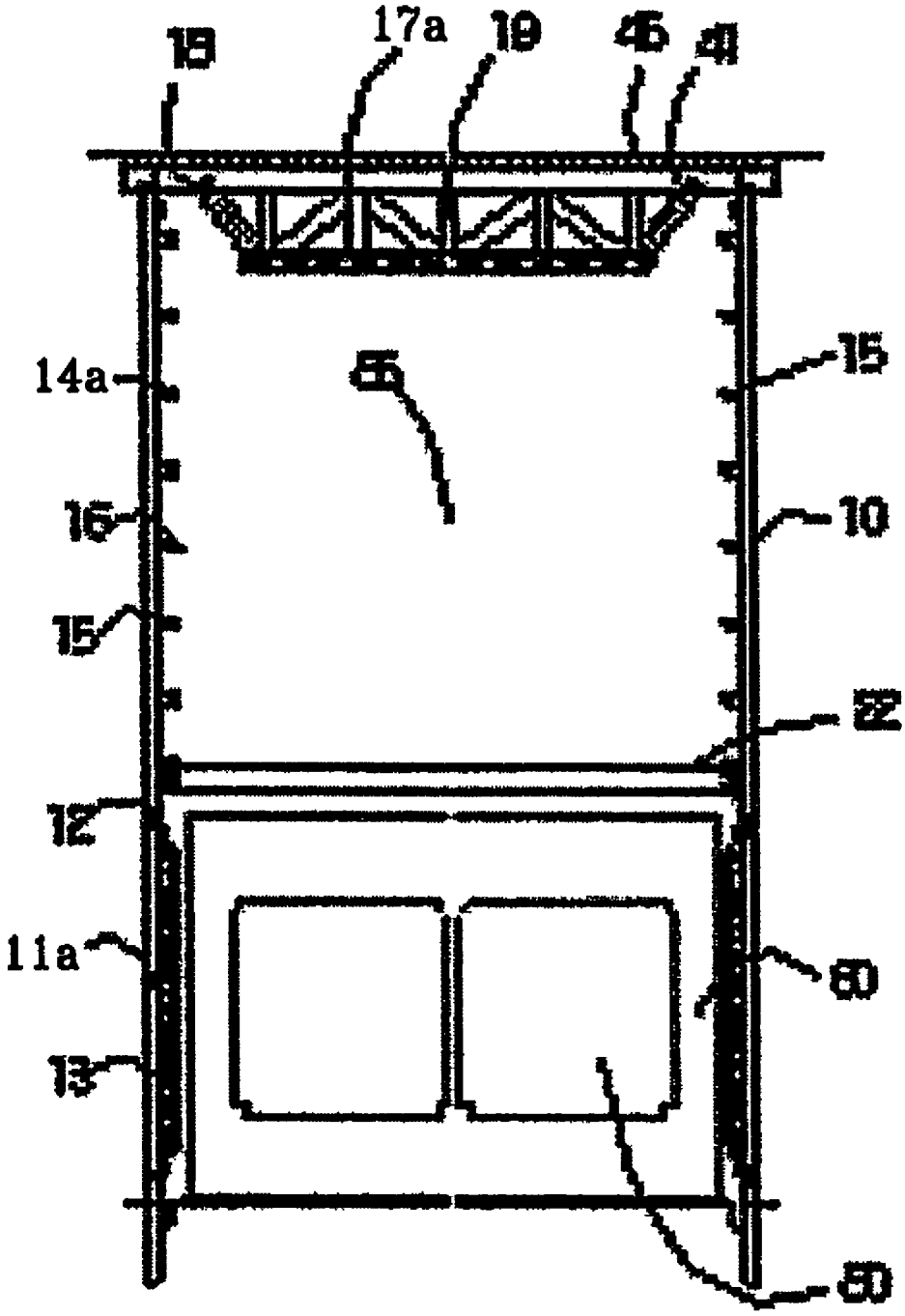
FIG. 12*a* is a cross sectional view showing the upper part of the excavated space horizontally pre-stressed and the lower part of the excavated space vertically pre-stressed by means of the tendons, the trusses, and the anchoring units according to the second preferred embodiment of the present invention, wherein struts are placed over a main structure.
Figure 12B:
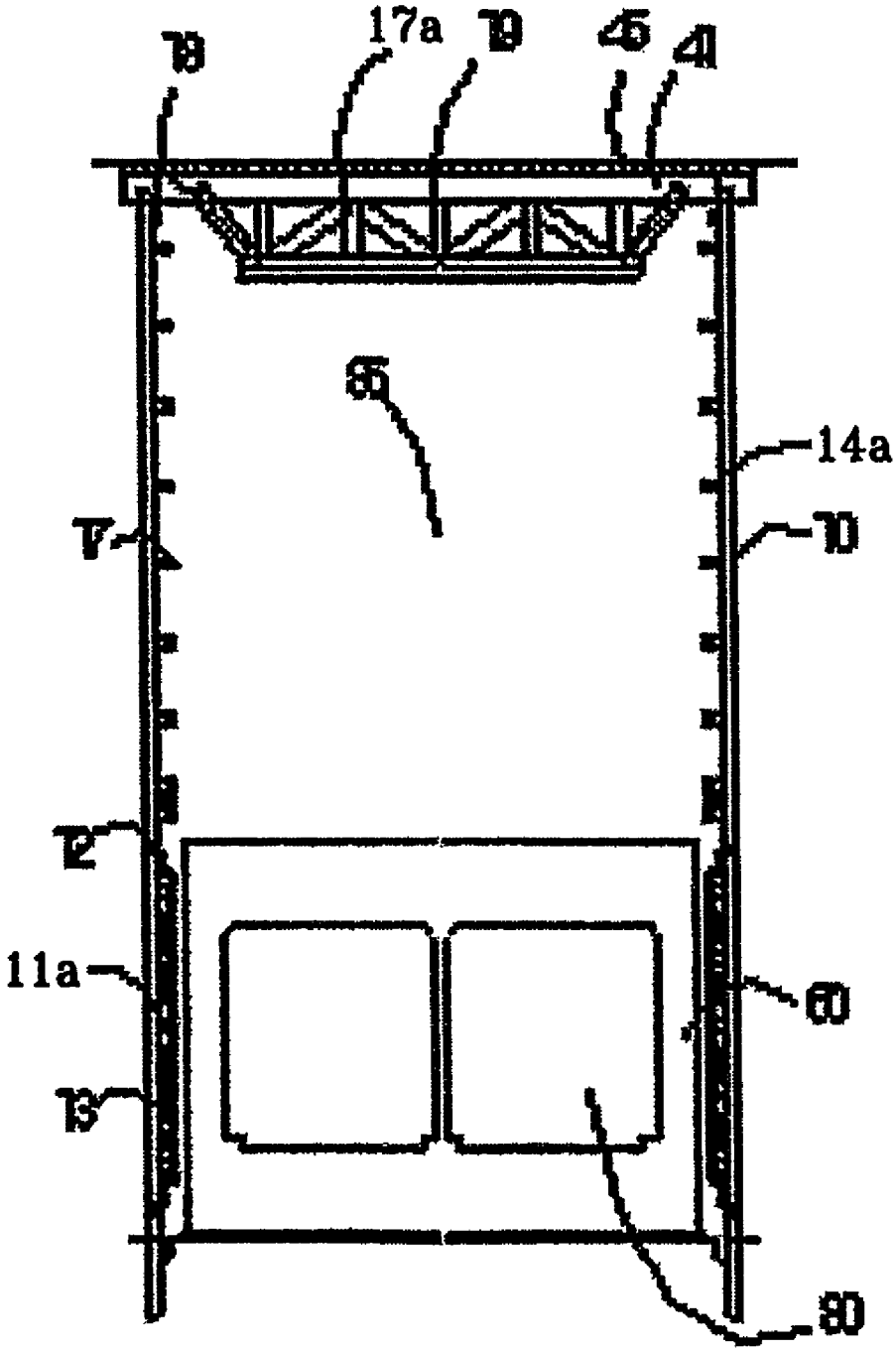
FIG. 12*b* is a cross sectional view showing the upper part of the excavated space horizontally pre-stressed and the lower part of the excavated space vertically pre-stressed by means of the tendons, the trusses, and the anchoring units according to the second preferred embodiment of the present invention.

FIG. 9 is a perspective view showing vertical piles prestressed with tendon-anchoring units and tendon supports disposed only at the lower part of the excavated space, where the main structure 60 is to be built. Although the struts 21 and 22 are closely arranged as in the conventional support system at the upper part of the excavated space, the tendon-anchoring units 12 and the tendon supports 11 are disposed at the part of the excavated space where the structure 60 is to be built.

Figure 13:
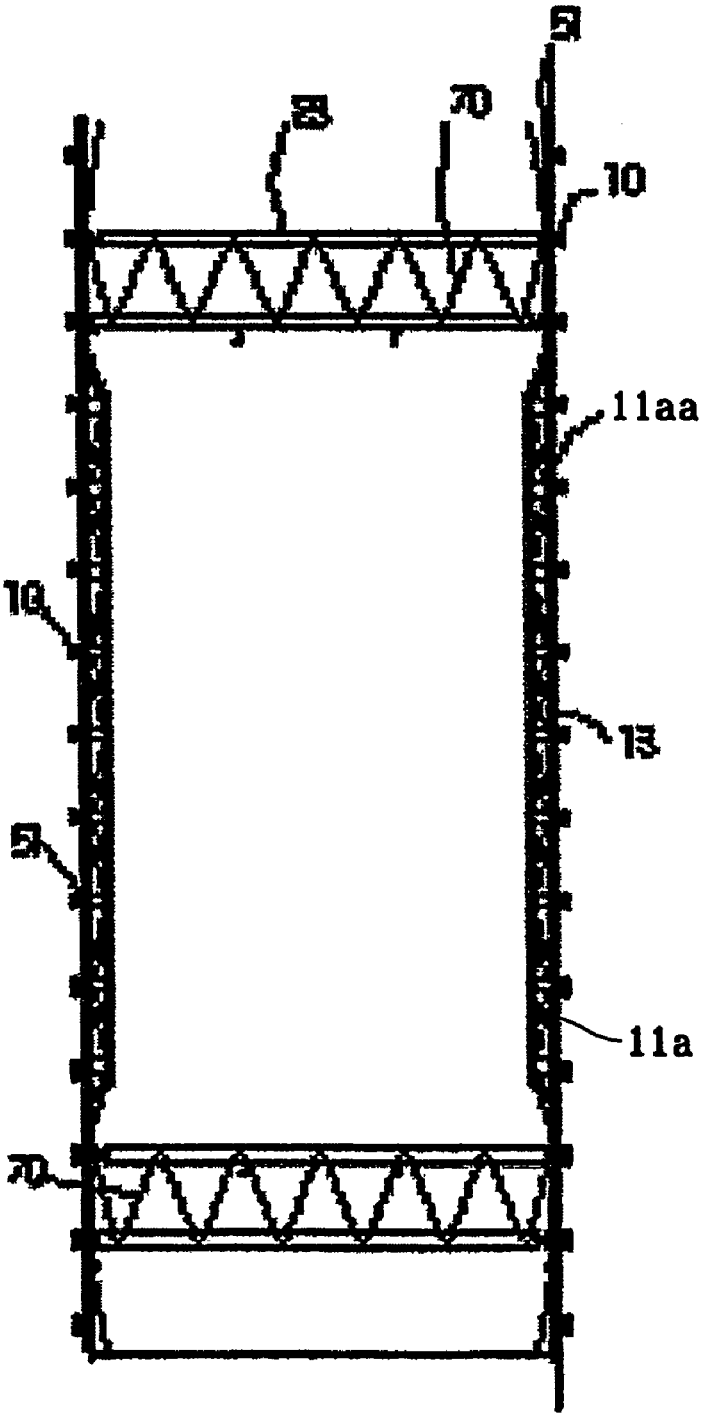
FIG. 13 is a plan view showing wales supported by means of tendons with the struts removed according to the second preferred embodiment of the present invention.
Figure 14:
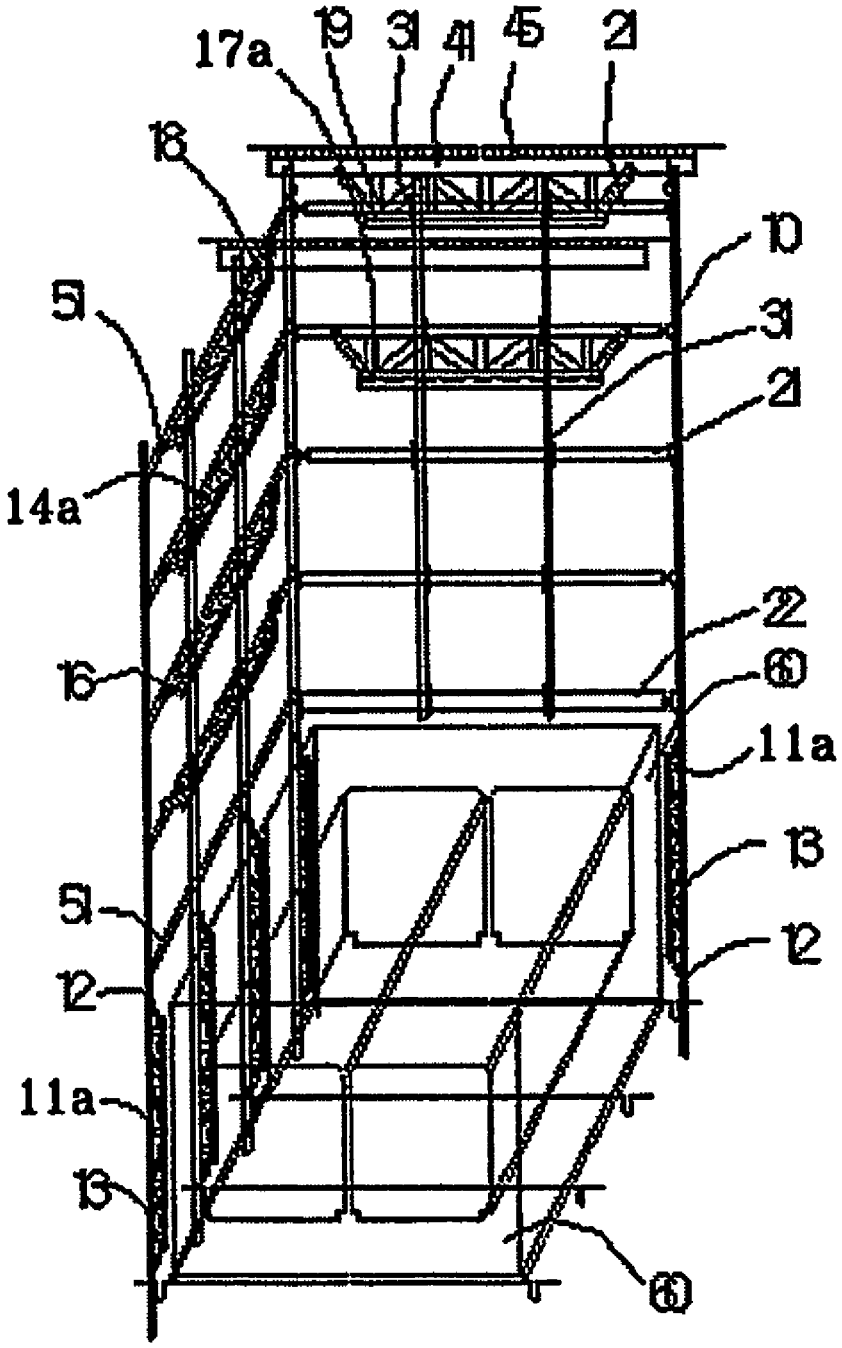
FIG. 14 is a perspective view showing a wide working space formed in the underground space by means of an appropriate combination of the layouts of FIGS. 11 and 12.
Figure 15A:
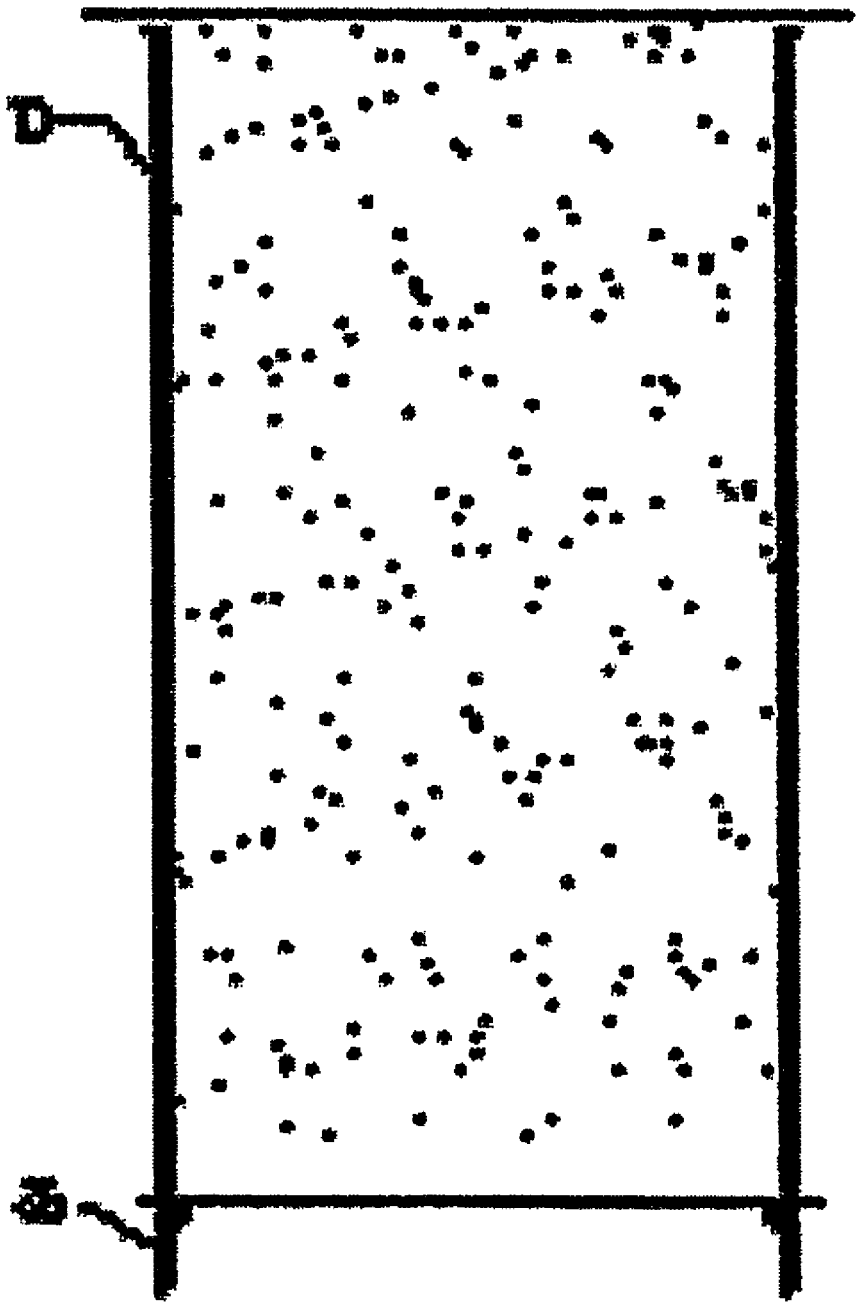
FIG. 15*a* is a cross sectional view showing the installation of a vertical pile prior to an excavating process according to the second preferred embodiment of the present invention.
Figure 15B:
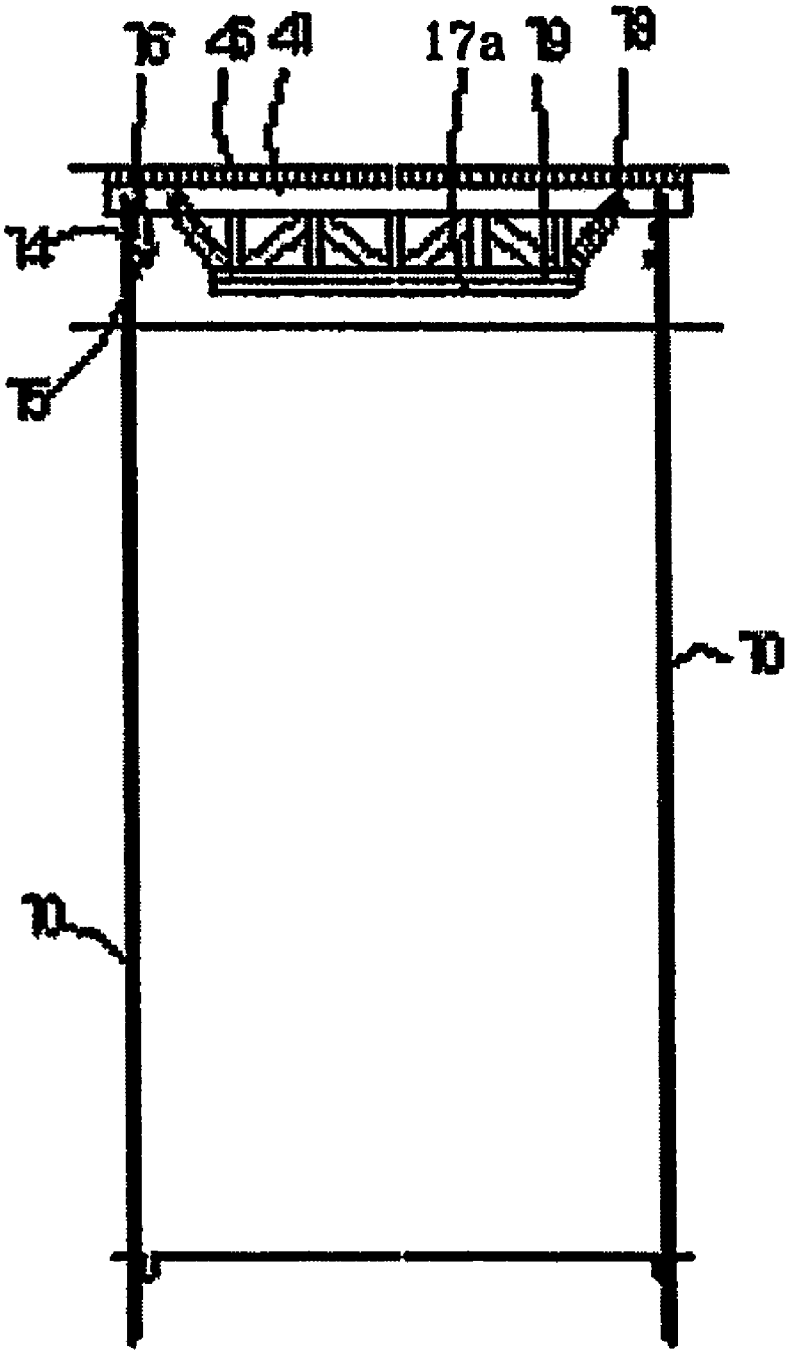
FIG. 15*b* is a cross sectional view showing an early step of the excavating process according to the second preferred embodiment of the present invention.
Figure 15C:
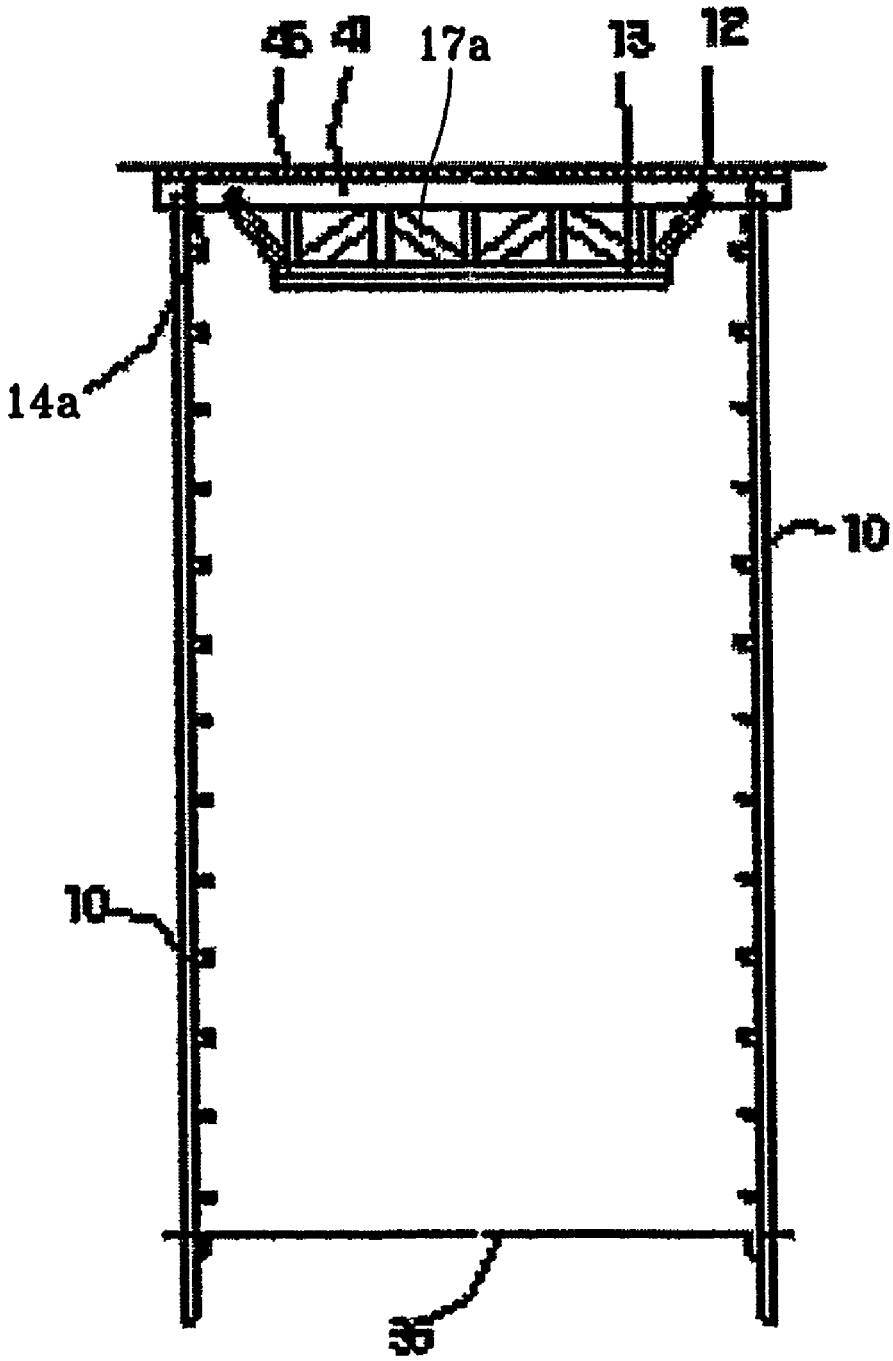
FIG. 15*c* is a cross sectional view showing the completion of the excavating process according to the second preferred embodiment of the present invention.
Figure 15D:
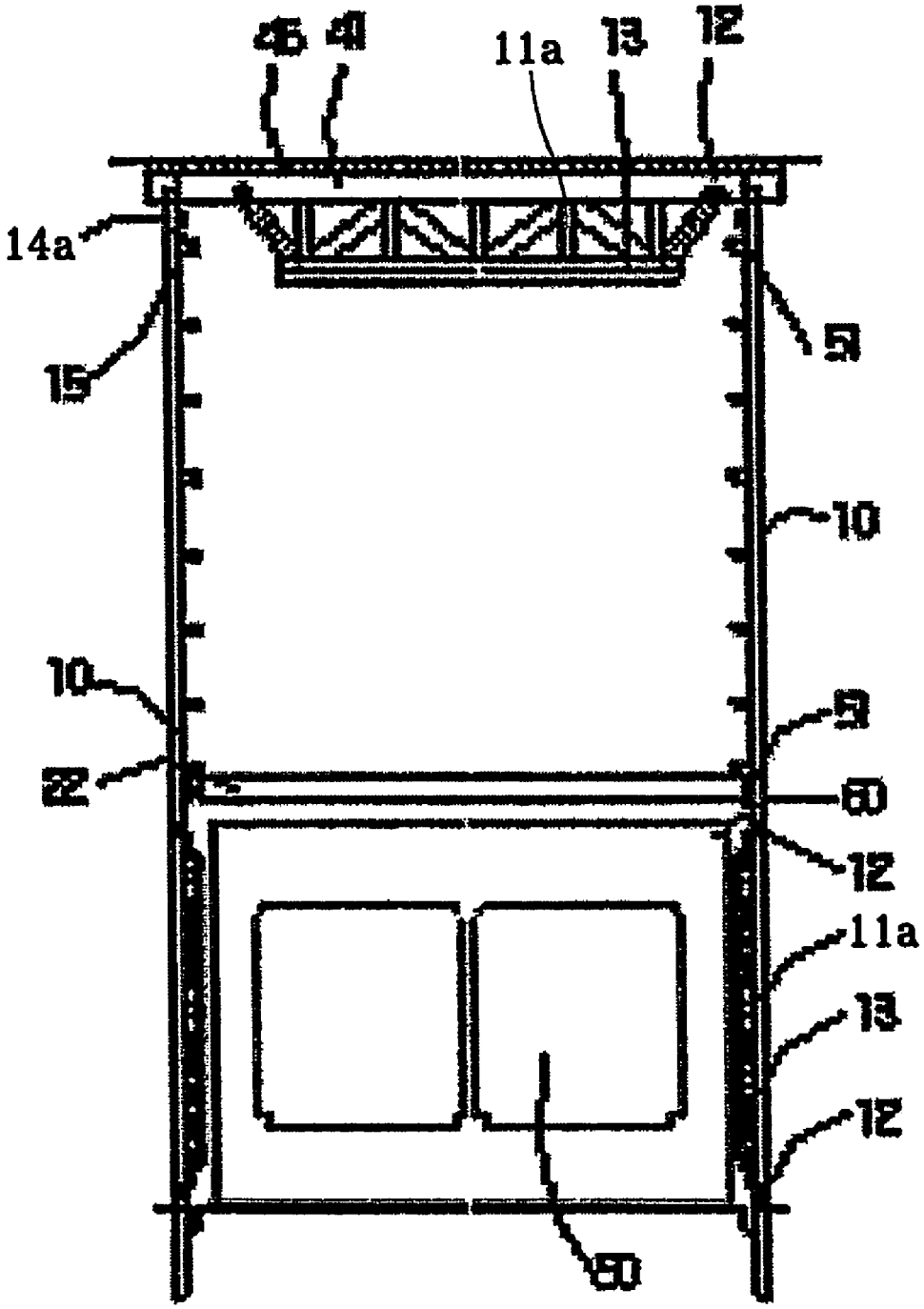
FIG. 15*d* is a cross sectional view showing the completion of a temporary structure according to the second preferred embodiment of the present invention.

FIGS. 10 to 15*d* are views showing a second preferred embodiment of the present invention. The second preferred embodiment of the present invention is identical to the first preferred embodiment of the present invention except that trusses 11*a*, 14*a*, and 17*a* are used instead of the tendon supports 11, 14, and 17. The tendons are supported by means of the trusses 11*a*, 14*a*, and 17*a* instead of the tendon supports so that the tendons can be more stably supported. Of course, the second preferred embodiment of the present invention has the same effect as the first preferred embodiment of the present invention. As shown in FIG. 13, the positions of the vertical supporting member 11*aa* of the trusses 11*a* correspond to those of the vertical piles 10, to which the earth pressure is directly applied, so that the bending moment is not developed in the wales 51. In this case, the length of the respective wales 51 is further increased as in the first preferred embodiment of the present invention.

Figure 16:
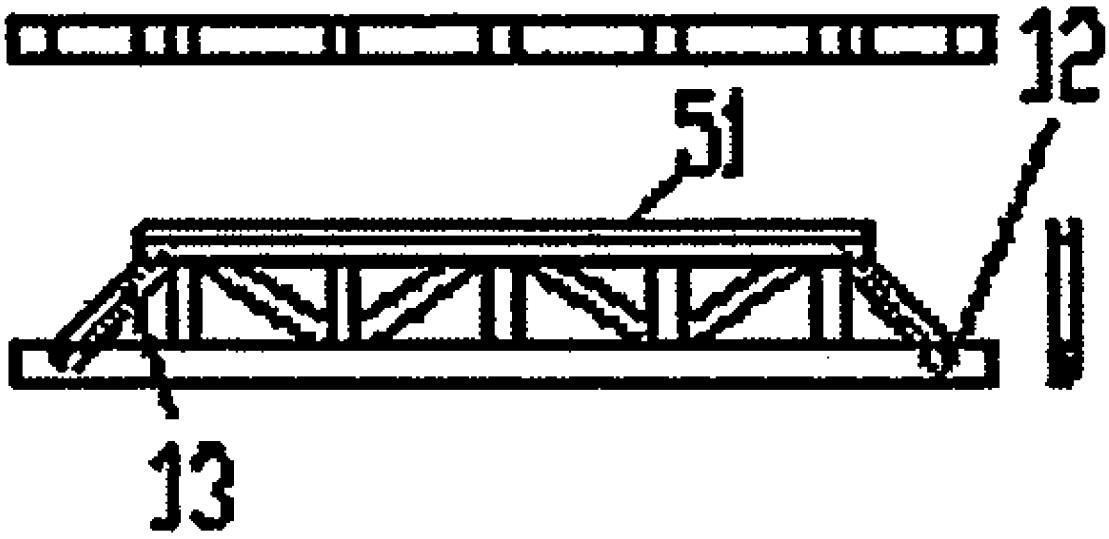
FIG. 16 is a detailed view showing the truss according to the second preferred embodiment of the present invention.
Figure 17A:
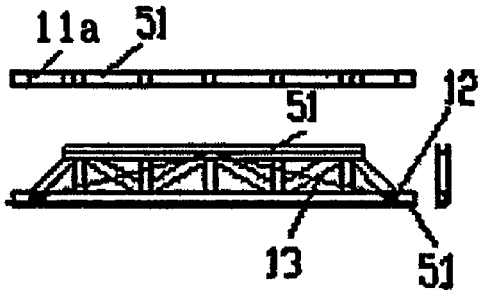
FIGS. 17*a* and 17*b* are views illustrating methods for placing tendons according to the second preferred embodiment of the present invention.
Figure 17B:
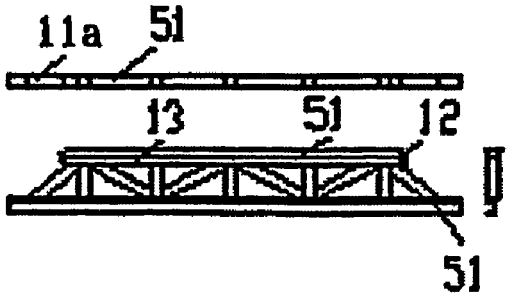

FIG. 16 is a detailed view showing the truss according to the second preferred embodiment of the present invention, and FIGS. 17*a* and 17*b* are views illustrating alternative methods for placing tensioning members according to the second preferred embodiment of the present invention. The tendons 13 are fixed only at the middle parts of the truss as shown in FIG. 17*a*. On the other hand, the tensioning members are placed only at one side of truss members as shown in FIG. 17*b*.

Figure 18:
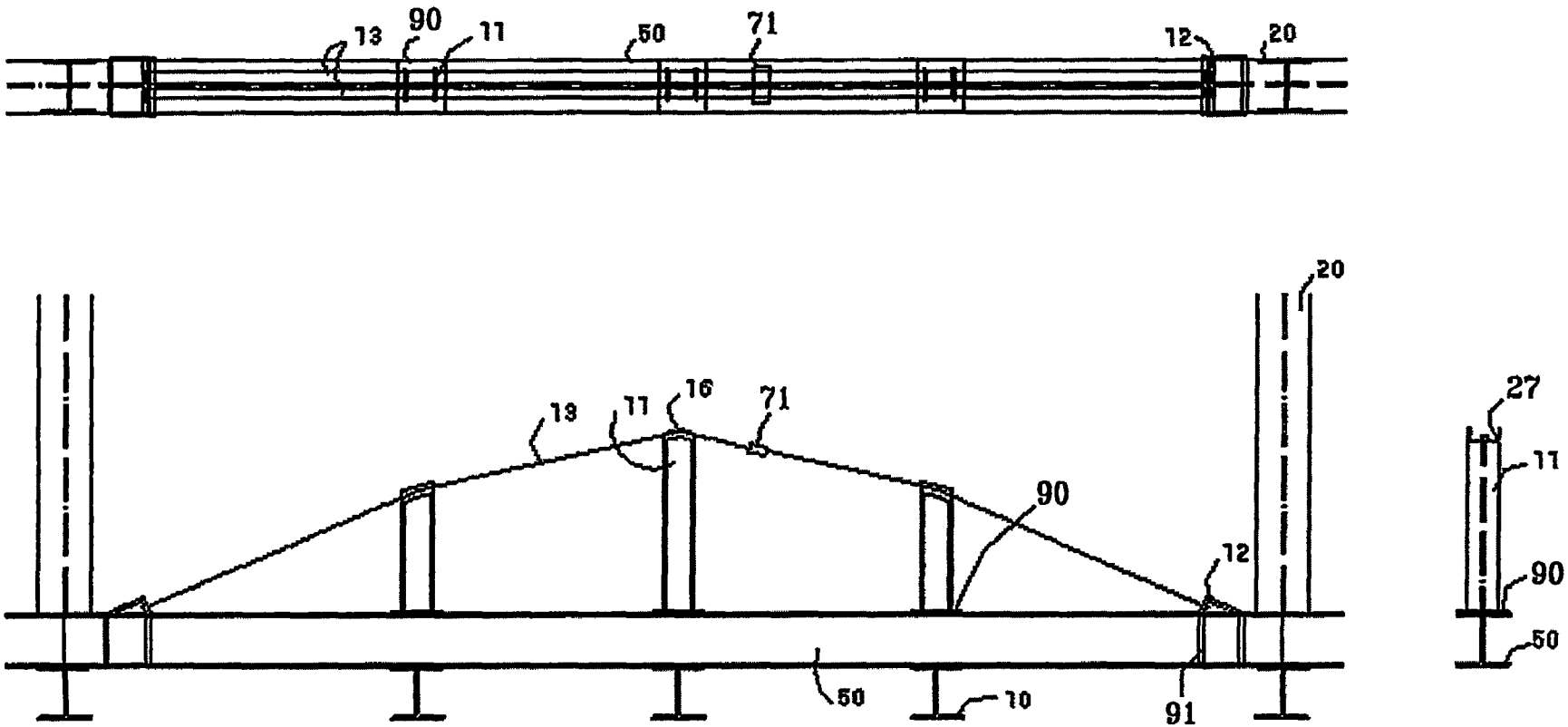
FIG. 18 is a drawing showing the placement of the tendon supports and the anchoring units according to the present invention in the case that H-type beams are used.

FIGS. 18 to 30 are detailed views showing the state of the tendon supports and the anchoring units used in the pre-stressed support system according to the present invention FIG. 18 shows the tendon supports 11 disposed at the appropriate positions of the wales 50 made of H-type steel materials, the anchoring units 12 disposed near both ends of the wales 50 so that the tendons 13 are tensioned and anchored, and the reinforced wales 50 supported by means of the struts 20 disposed at both ends of the wales 50, which are respectively shown in a plan view, a front view, and a side view. As shown in FIG. 18, the tendon supports 11, the anchoring units 12, and the tendons 13 are further provided to carry out the pre-stressed support system according to the present invention.

The tendon supports 11 may be made of various steel members, such as H-beams, angles, square rods, or other members for withstanding compression load. It is most preferable that the anchoring units 12 are made of steel since most of the wales 50 are made of steel, although the anchoring units 12 could be made of other materials. The tendons are usually used as tensioning members for applying a tensioning force. Additional elements are generally required, such as wedges, to anchor the tendons. However, it is very inconvenient to mount and remove the additional elements. Consequently, it is possible to use other devices such as tie cables or threaded steel rods. Alternatively, couplers 71 may be conveniently used. Also, the tensioning members may be made from high strength materials that have been developed recently and widely used, such as carbon fibers, glass fibers, aramid fibers, or etc.

FIG. 18 shows that the tendon supports 11 and anchoring units 12 are attached to the wales 50 by means of welding. The positions of the vertical tendon supports 11 correspond to those of the vertical piles (H-piles) 10 in the conventional support system so that the moment acting on the wales 50 is minimized. Preferably, the struts 20 correspond to the vertical piles 10 as shown in FIG. 18.

Figure 19:
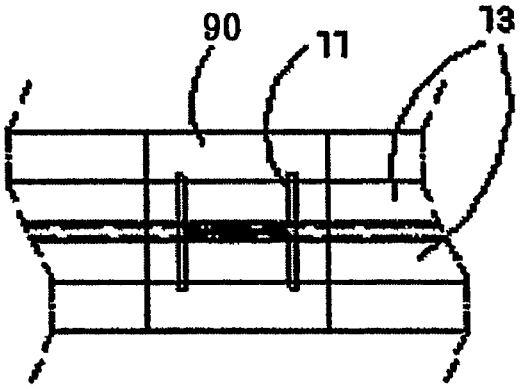
FIG. 19 is a detailed view showing the tendon supports of FIG. 18.
Figure 19:
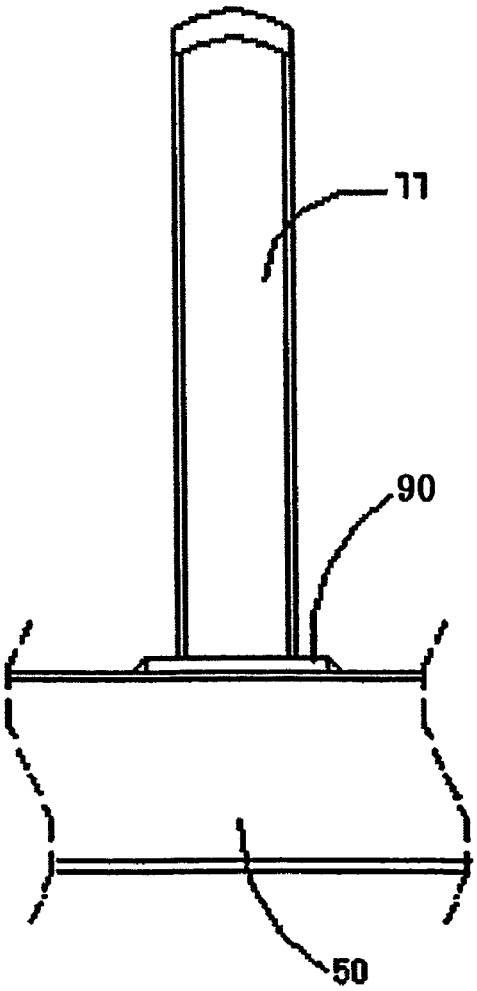
Figure 19:
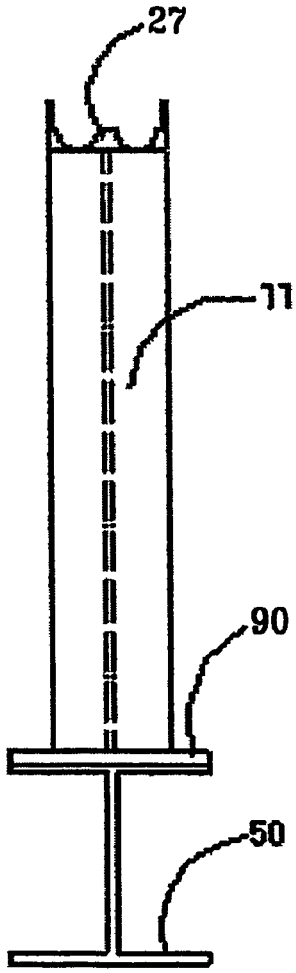

FIG. 19 is a detailed view showing the shape of the tendon support of FIG. 18 and how the tendon support is attached to the wale. At the lower end of the tendon support a flat support plate 90, is attached so that the tendon support can be easily attached to the wale 50, as shown in FIG. 19. It should be noted, however, that the flat support plate is not indispensable. At the upper end of the tendon support is disposed a tendon base 27 having a curved tendon guide.

Figure 20:
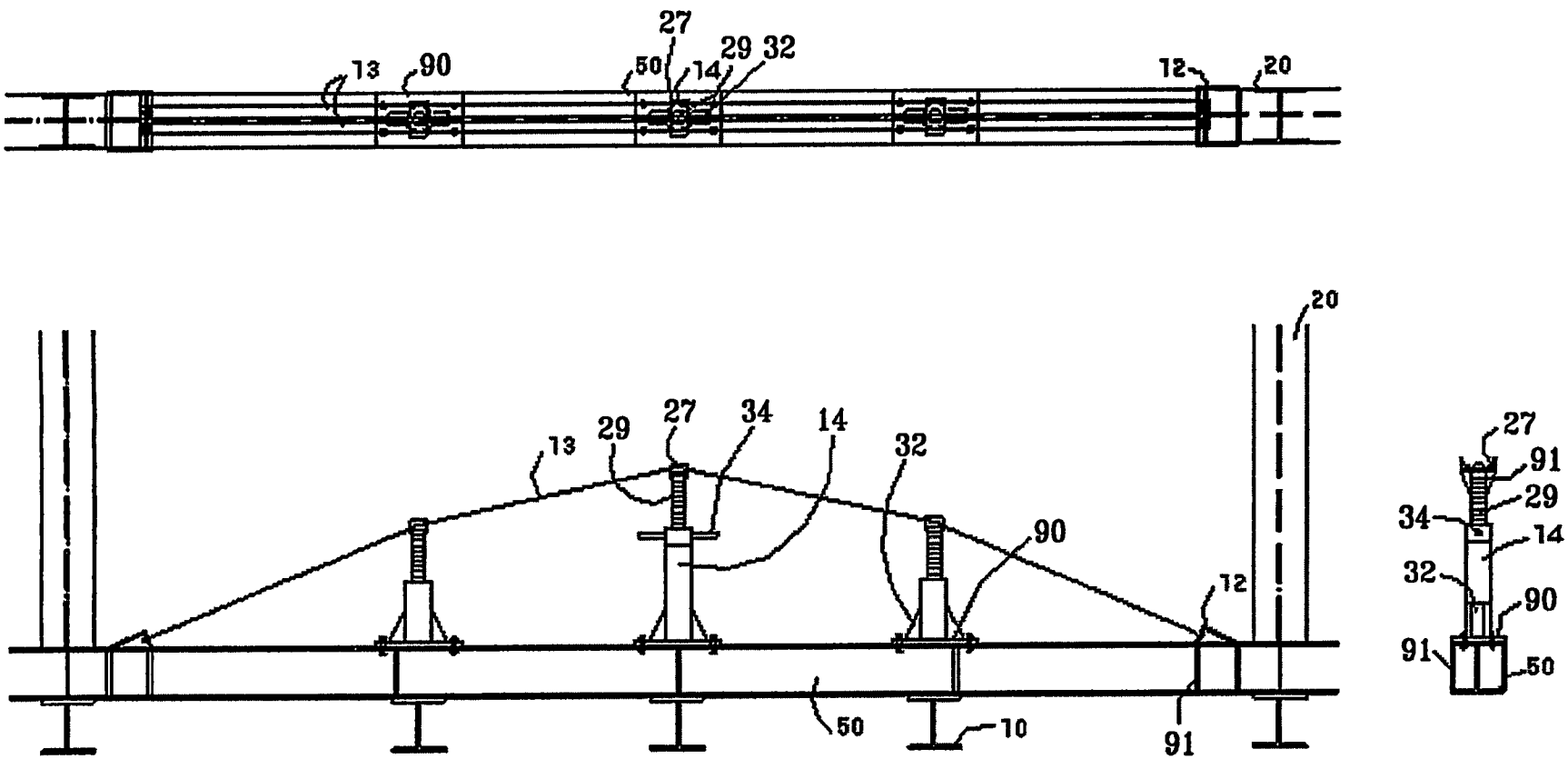
FIG. 20 is a drawing showing the placement of the tendon supports, whose height is adjustable, and the anchoring units according to the present invention.

FIG. 20 shows the tendon support 14 having a length-adjustable device 29, which is attached to the wale. The height of the tendon support is adjusted by means of the thread part so that a force applied to the tendon support can be easily changed. The tendon support 14 is attached to the wale by means of bolts. Below the tendon base 27 may be disposed a gusset plate 91 for withstanding the tensional force applied to the tendon base 27 due to the tension of the tendon 13. A gusset plate may be mounted, if necessary, to the lower end of the wale where the tendon support is disposed. Reference numeral 32 indicates a tendon support gusset plate, and reference numeral 34 indicates an adjusting knob.

Figure 21:
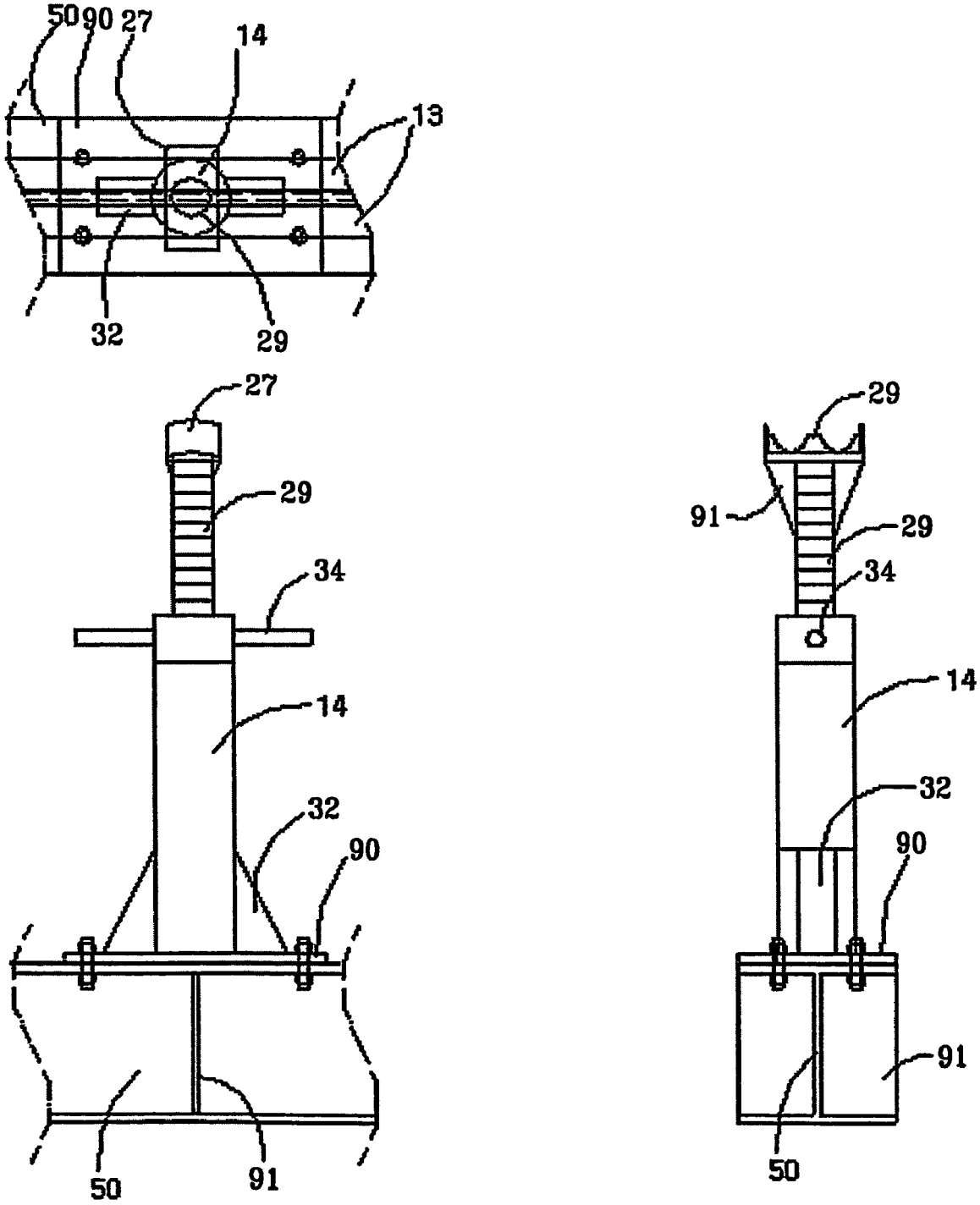
FIG. 21 is a detailed view showing the height-adjustable tendon supports of FIG. 18.

FIG. 21 is a detailed view showing the shape of the tendon support of FIG. 20 and how the tendon support is attached to the wale. The tendon support has a thread part 29 so that the height of the tendon support can be adjusted. The support plate 90 disposed at the lower end of the tendon support is fixed to the wale 50 by means of bolts so that the tendon support is securely attached to the wale. The gusset plate 91 is preferably attached to the wale in the case that the compression force acting on the tendon support is larger that the compression load transmitted to the wale as the earth pressure is increased.

Figure 22:
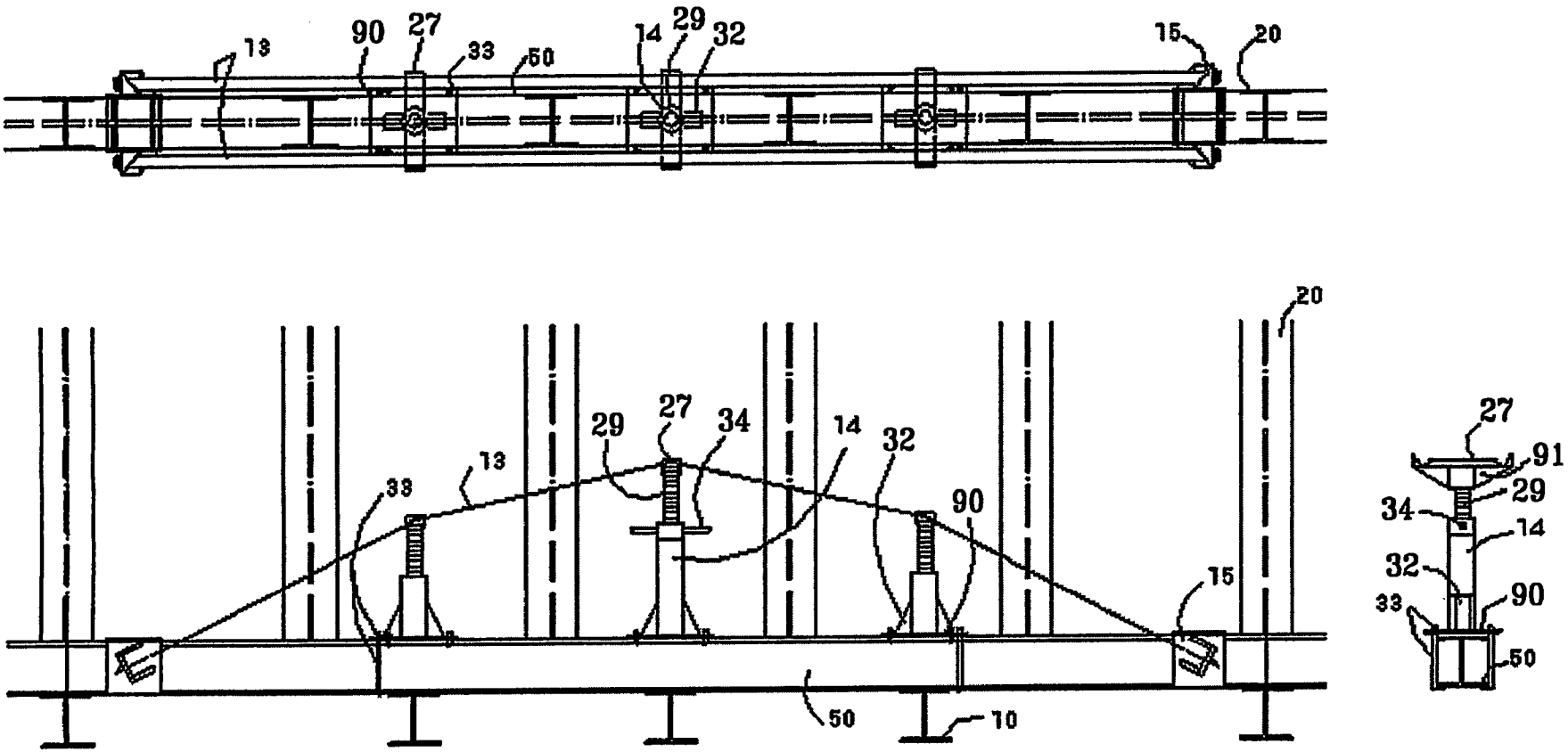
FIG. 22 is a drawing showing the placement of the height-adjustable tendon supports and the anchoring units according to the present invention, which are attached to the side of the wales so that the tendons can pass through the struts.

FIG. 22 shows the existing temporary support structure having the struts attached to the wales, to which the support system of the present invention is applied. The tendon base 27 is extended in the lateral direction so that the tendon 13 passes outside of the strut 20. The tendon support 14 may be fixed to the wale by means of "L"-shaped bolts 33 instead of welding or general bolts. The tendon-anchoring units 15 are attached to the sides of the wale 50 while being apart from the strut The lower parts of the tendon supports are reinforced as follows: The lower part of the middle tendon support is not reinforced while the lower parts of the side tendon supports provided at both sides of the middle tendon support, which are partially eccentric, are reinforced. Specifically, only the side tendon supports are fixed to the wale by means of the "L"-shaped bolts 33 so that the side tendon supports can withstand an even larger force.

Figure 23:
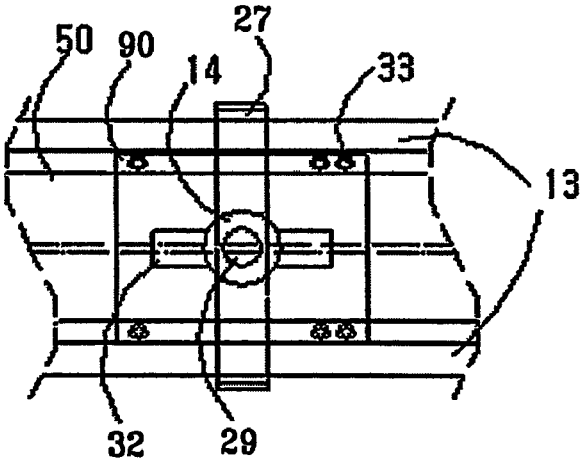
FIG. 23 is a detailed view showing the wide tendon supports of FIG. 22.
Figure 23:
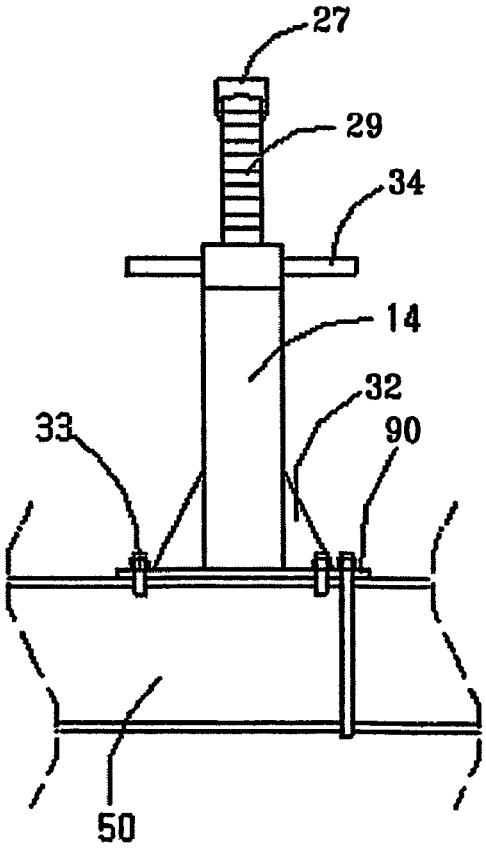
Figure 23:
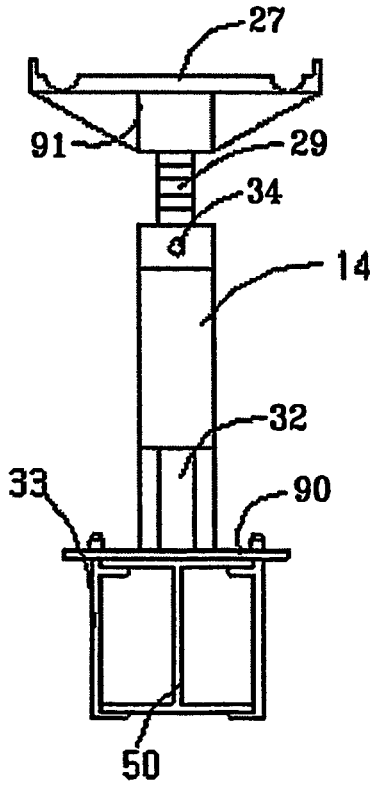

FIG. 23 is a detailed view showing the shape of the tendon support of FIG. 22 and how the tendon support is attached to the wale. The tendon support is fixed to the wale by means of the "L"-shaped bolts 33. Consequently, the tendon support can be easily fixed to the wale without deformation of the wale. These fixing units may be classified into a long fixing unit and a short fixing unit so that they can be fixed to the upper and lower flanges of the wale. When tensioned, the compression force is mainly applied to the tendon support. As a result, a welding or bolting work which needs a large force, is not necessary for fixing the tendon support to the wale. As shown in FIG. 23, the tendon base 27 is extended so that it is apart from the struts, and the tendon base is supported with the gusset plates 91.

Figure 24:
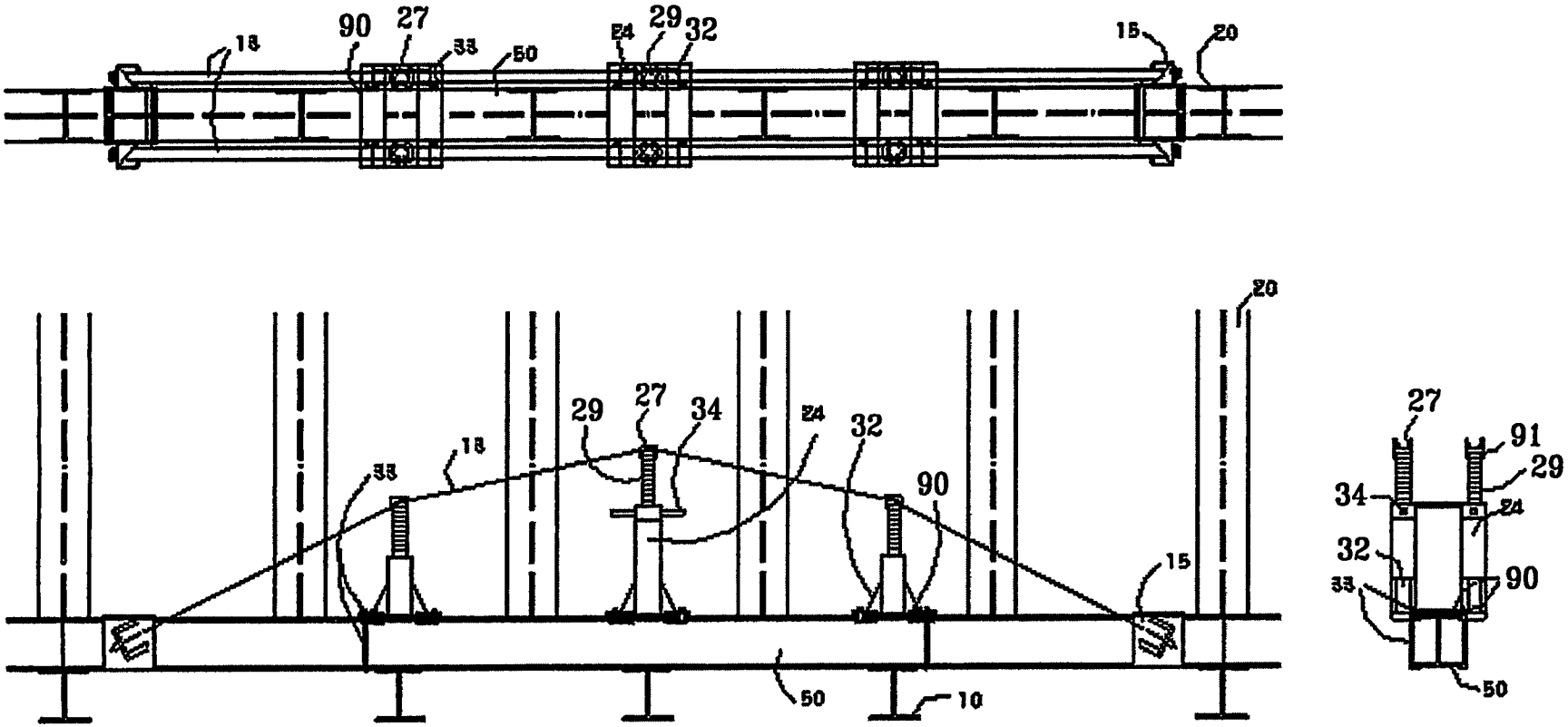
FIG. 24 is a drawing showing the placement of the height-adjustable tendon supports and the anchoring units according to the present invention, which are attached to the wales so that the tendons can pass through the struts.

As shown in FIG. 24, tendon supports 24 are disposed at both sides of the wale so that they are apart from the struts 20. The "L"-shaped bolts 33 and the height-adjustable tendon support are used, which are similar to those of FIG. 22.

Figure 25:
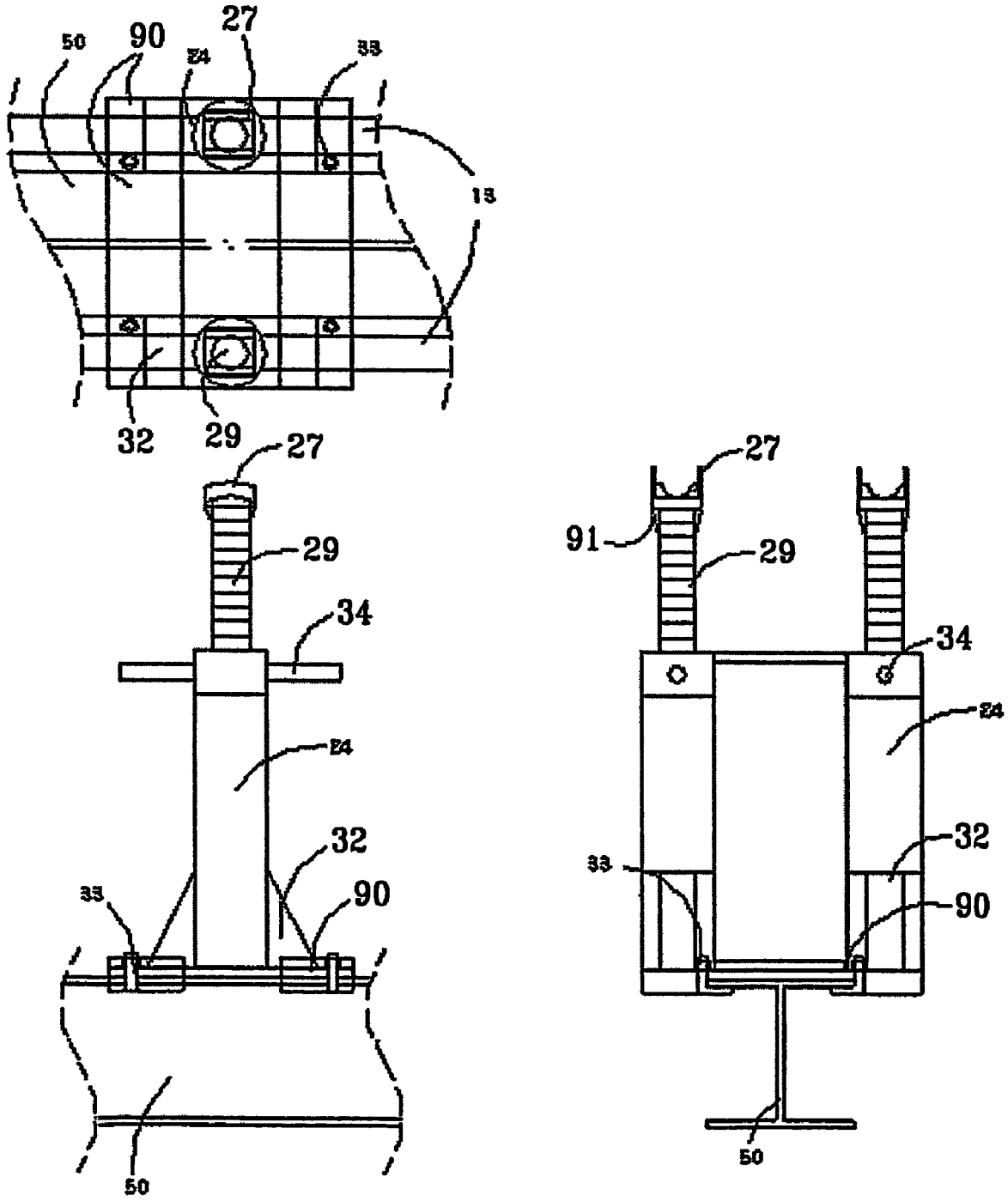
FIG. 25 is a detailed view showing the tendon supports of FIG. 24.

FIG. 25 is a detailed view showing the shape of the tendon supports of FIG. 24 and how the tendon supports are attached to the wale. The tendon supports are fixed to the wale with "L"-shaped bolts 33, and the height-adjustable tendon supports are used. As shown in FIG. 25, the tendon supports are fixed to the sides of the wale, and the tendon supports are connected to each other with the tendon support plate 90.

Figure 26:
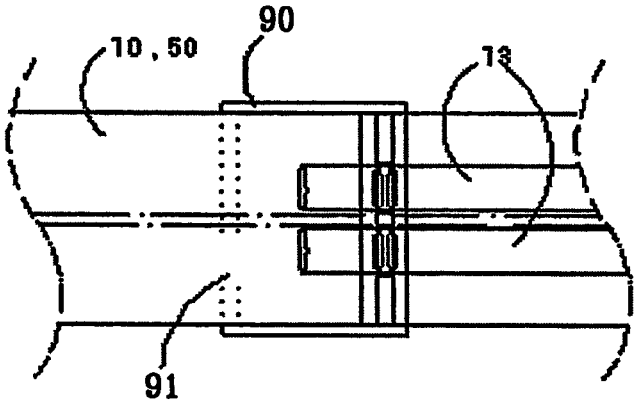
FIG. 26 is a detailed view showing the anchoring unit attached to the flange of the wale shown in FIGS. 18 and 20 by means of welding.
Figure 26:
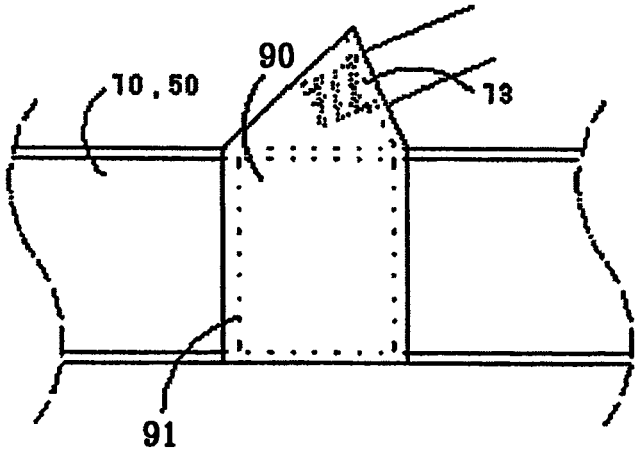
Figure 26:
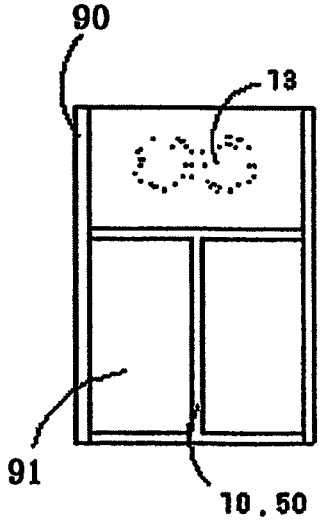

FIG. 26 is a detailed view showing the anchoring unit attached to the upper surface of the wale by means of welding. The gusset plates 91 are disposed between the flanges. The tendon support plate 90 is fixed to the sides of the flanges by means of welding, and the supporting steel is attached to the anchoring steel plate by means of welding. Finally, the tendons 13 is securely fixed. The anchoring unit fixed to the flange surfaces by means of welding is also applied to the vertical piles as well as the wale.

Figure 27:
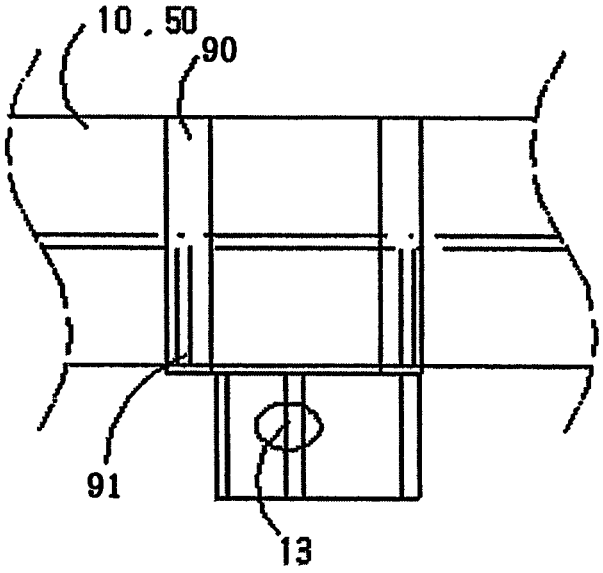
FIG. 27 is a detailed view showing the anchoring unit for anchoring tendons or tie cables to the wale shown in FIGS. 22 and 24 at both sides thereof.
Figure 27:
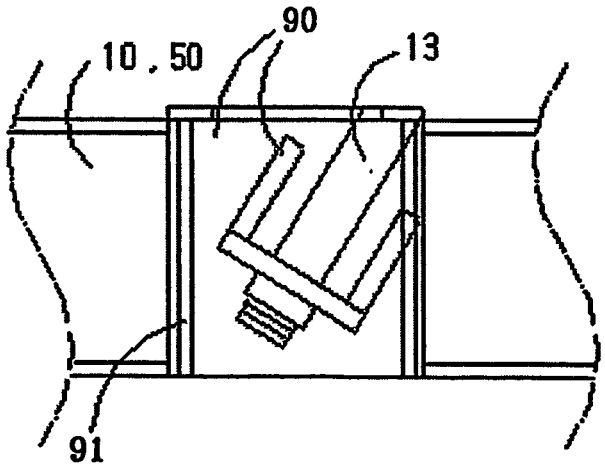
Figure 27:
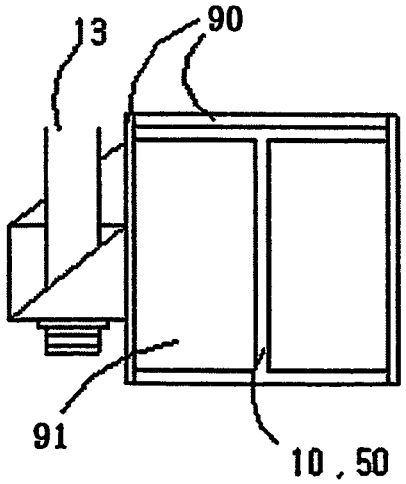

FIG. 27 is a detailed view showing the anchoring unit disposed at the side of the wale. The gusset plate 91 is disposed between the flanges. The tendon support plate 90 including the anchoring unit is fixed to the sides of the flanges by means of welding so that the tendon is securely fixed. The anchoring unit fixed to both side of the flange is also applied to the vertical piles as well as the wale.

Figure 28:
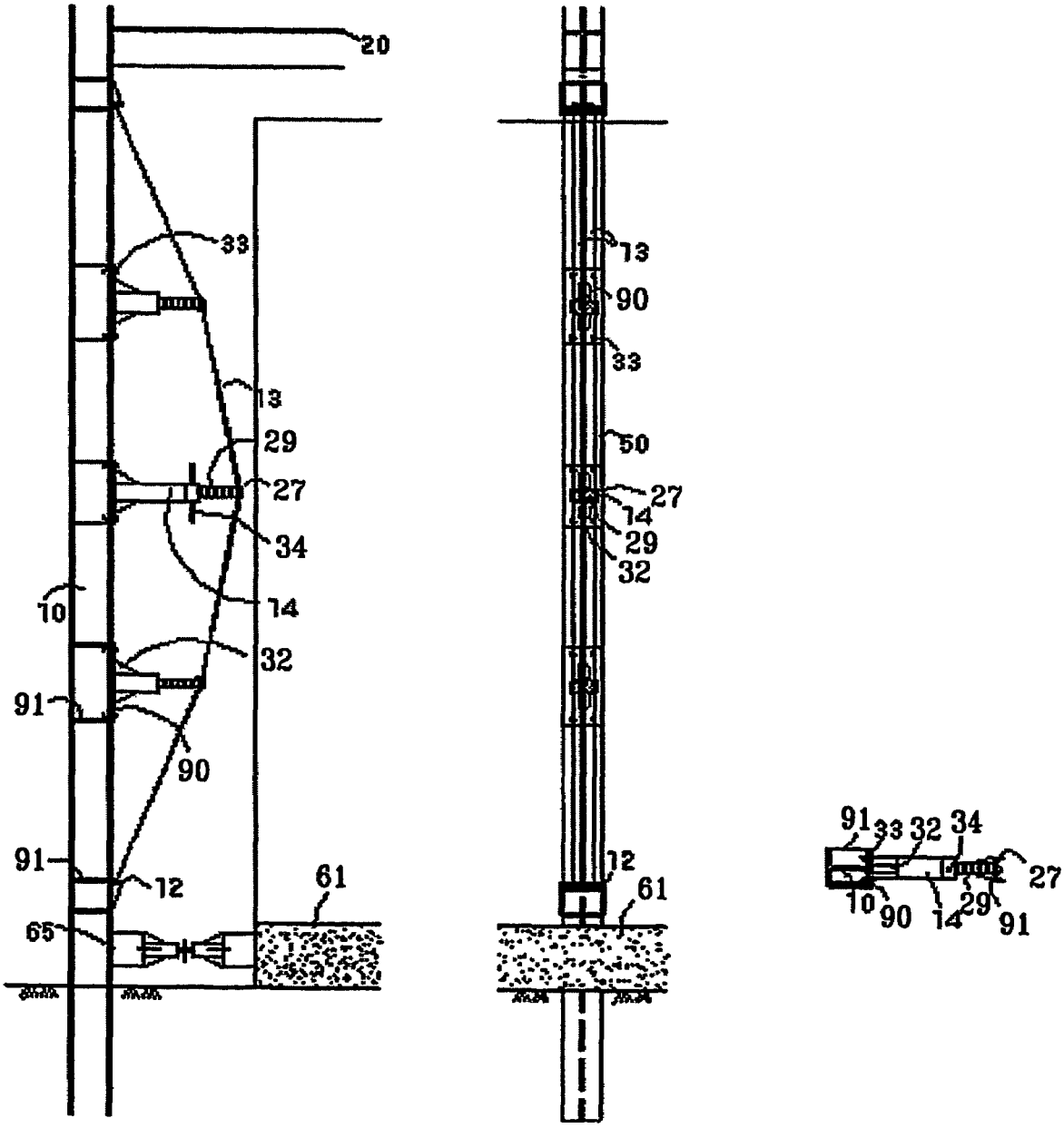
FIG. 28 is a drawing showing the placement of the height-adjustable tendon supports and the anchoring units according to the present invention, which are attached to the vertical piles.

FIG. 28 shows the vertical pile with the struts not fixed thereto, to which the pre-stressed support system of the present invention is applied. After a floor slab 61, which is a part from the main structure, is built, a jack support 65 is attached to the slab so that the lower part of the vertical pile is supported by means of the jack support. The gusset plate 91 is disposed between the flanges at the lower ends of the tendon support so that tie cables are tensioned. The anchoring unit fixed to the flanges by means of welding as shown in FIG. 26 may also be used.

Figure 29:
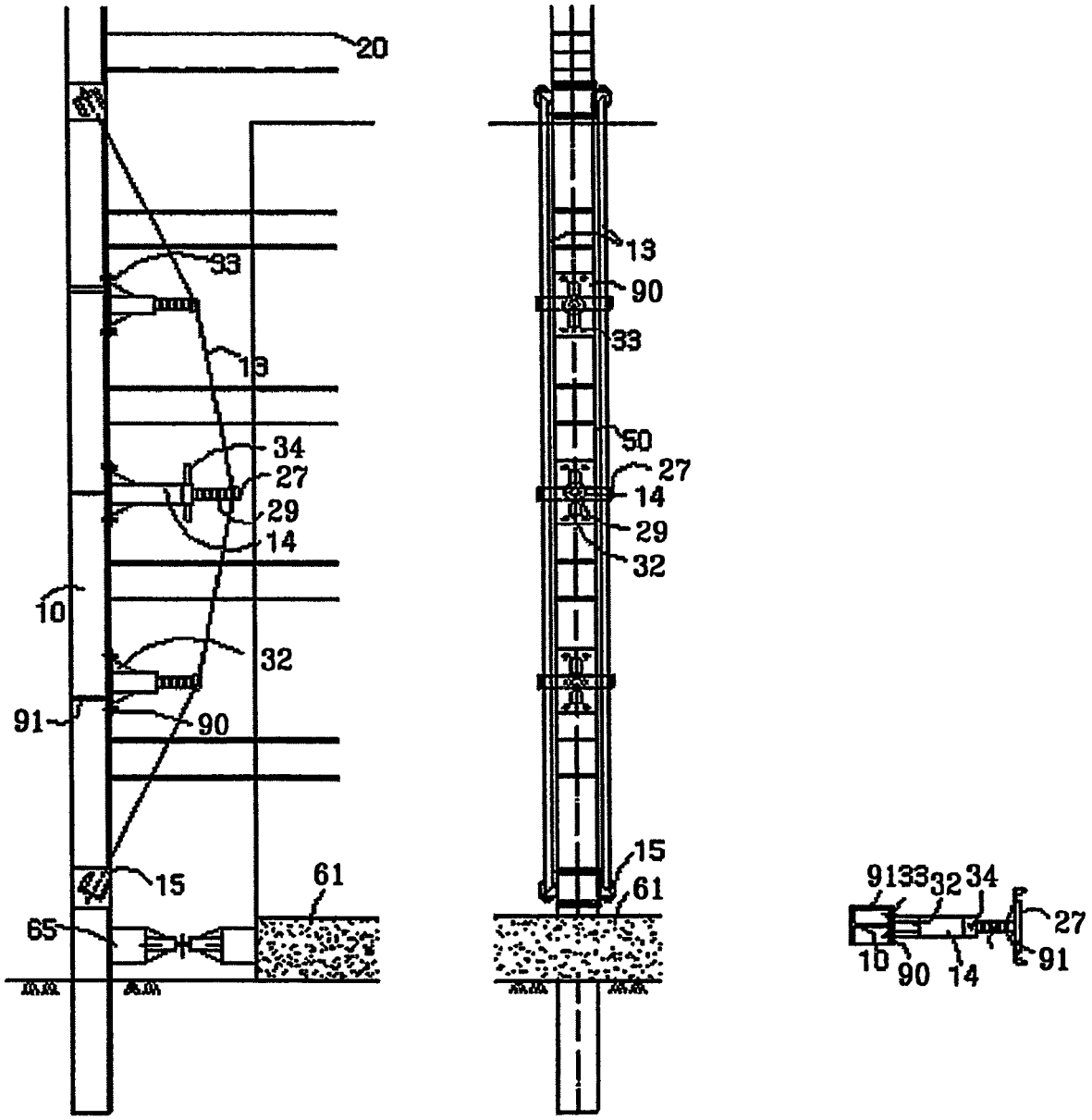
FIG. 29 is a view showing the placement of the height-adjustable tendon suppports and the anchoring units according to the present invention, which are attached to the vertical piles so that the tendons can pass through the struts.

FIG. 29 shows the vertical pile with the struts fixed thereto, to which the pre-stressed support system of the present invention is applied. After the floor slab 61, which is a part from the main structure, is built, the jack supporter 65 is attached to the slab so that the lower part of the vertical pile is supported by means of the jack support. The gusset plate 91 is fixed to the vertical pile by means of bolts so that tendons are tensioned. The support system, which is shown in FIGS. 22 and 23, may also be applied to the vertical pile of FIG. 29.

Figure 30:
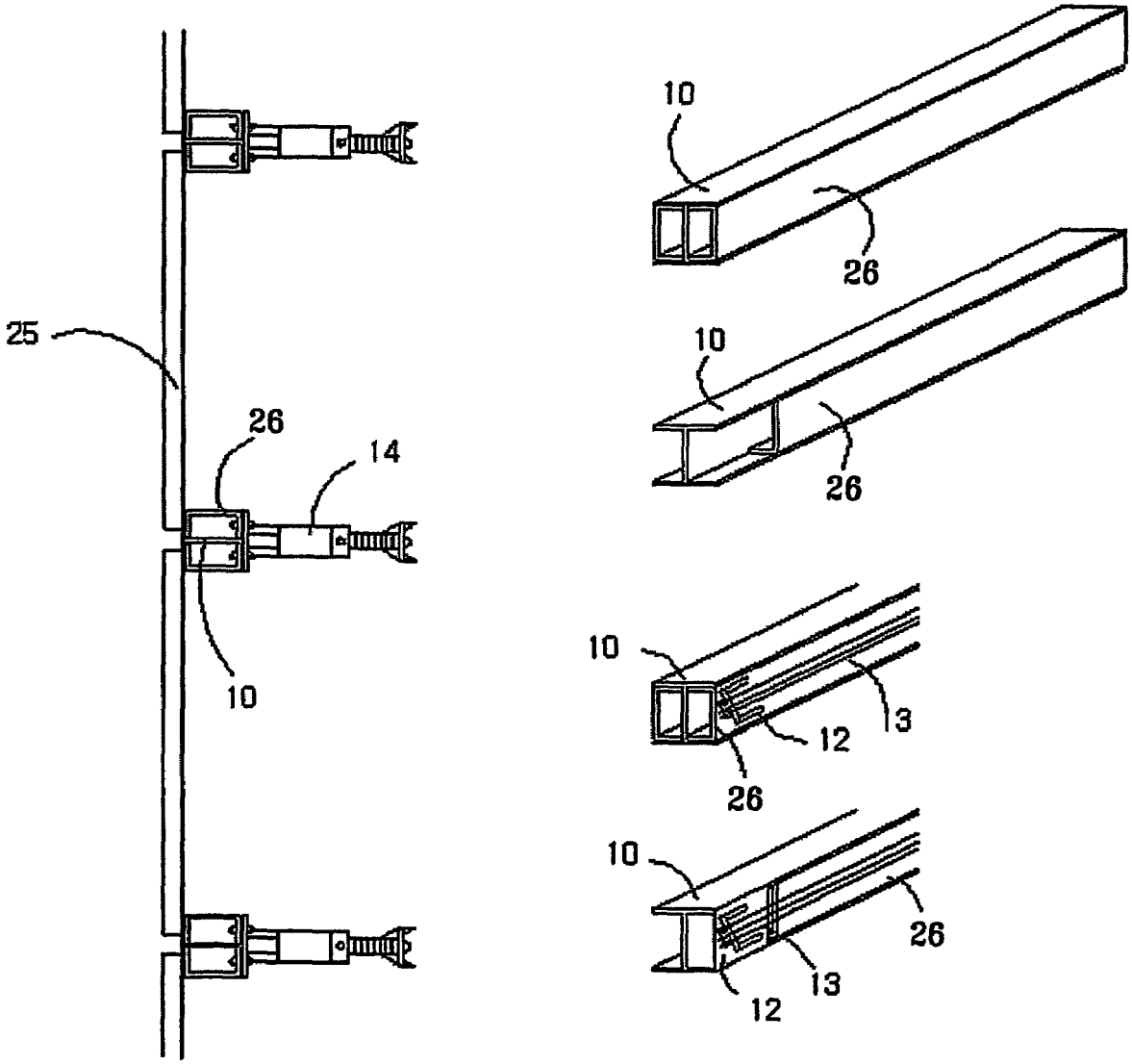
FIG. 30 is a view showing the placement of the tendon supports and the anchoring units according to the present invention, wherein "["-shaped channels are inserted in the vertical piles so that the vertical piles can withstand larger compression force with smaller eccentricity.

FIG. 30 shows the vertical piles to which the prestressed support system of the present invention is applied. Between the flanges of the vertical piles are inserted "[]"-shaped channels 26 so that the vertical piles are reinforced. In this case, the vertical piles can withstand large compression force, which can reduce the eccentricity of the vertical prestressing. The distance between the tendon support 14 and the main structure is increased, whereby the construction is rapidly carried out. The anchoring units 15 are fixed to the "[]"-shaped channels. Alternatively, the anchoring units 15 may be fixed to the flanges, as in FIG. 27, or the anchoring units 12 directly fixed to flange surfaces by means of welding as shown in FIG. 26 may also be used. Reference numeral 25 indicates earth retaining plates.

As apparent from the above description, the present invention provides a pre-stressed support system that is capable of pre-stressing vertical piles, wales, and main girders by means of a plurality of tendon supports, anchoring units, and tendons, whereby the number of struts and middle piles, which are serious obstacles to carrying out the conventional construction works, is considerably reduced, and thus the constructional efficiency and economic efficiency of excavation and support works are greatly improved. Also, formation of holes in the structure, which is inevitable in the conventional support system, is effectively prevented or reduced. Consequently, rebar works or form works can be easily and conveniently carried out, water-tightness of the structure is perfectly guaranteed, and durability of the structure is improved. Furthermore, the anchoring units and tendon supports used in the pre-stressed support system of the present invention can withstand tension and compression forces applied to the original members by the provision of appropriate stiffeners when the vertical piles and the wales are pre-stressed by means of tensioning members. The tendon supports in various kinds and shapes may be used so that the supporting force at the respective tendon supports can be adjustable. Moreover, the anchoring units are disposed so that the tensioning members can be tensioned while being apart from the existing struts, whereby the earth pressure and the water pressure are effectively and stably withstood.

Although the preferred embodiments of the present invention have been disclosed for illustrative purposes, the engineers in this field will understand that various modifications, additions and substitutions are possible, without departing from the scope and spirit of the invention as disclosed in the accompanying claims.

What is claimed is:

1. A pre-stressed support system for supporting the excavated ground load by using supporting members, a tendon support member being arranged about the central region of said supporting members along a longitudinal direction of said support members, a plurality of tendon support members each height being gradually decreased from the center of said supporting members toward both directions thereof and each being disposed at a predetermined interval, and tensioning members being fixedly supported on said plurality of tendon support members to thereby form an overall semi-parabola shape.

2. The system as defined in claim 1, wherein said supporting members are horizontal beams such as wale for supporting the excavated ground.

3. The system as defined in claim 1, wherein said supporting members are vertical piles for supporting the excavated ground.

4. The system as defined in claim 1, wherein said supporting members are main girder for withstanding load.

5. The system as defined in claim 1, wherein said supporting members are H-piles, steel piles having circular or square sections, or concrete piles having circular or square sections.

6. The system as defined in claim 1, wherein said tensioning members are selected from a group consisting of tendons, carbon fibers, glass fibers, aramid fibers, and etc.

7. The system as defined in claim 3, wherein said tendon support members and said tensioning members are attached to said supporting members so that said supporting members are pre-stressed at the upper and lower parts thereof in the longitudinal direction, and struts for supporting said supporting members are further provided.

8. The system as defined in claim 3, wherein said tendon support members and said tensioning members are attached to said supporting members so that said supporting members are pre-stressed at the lower part thereof in the longitudinal direction, and said supporting members are disposed at both sides of the excavated underground space in the lateral direction and longitudinal direction in large numbers, and said tendon support members and said tensioning members are attached to main girders so that they are pre-stressed and, said main girders are attached to the upper ends of said supporting members disposed at both sides of the excavated underground space so that cover plates are placed on said main girders, a main structure is built in the space between said supporting members disposed at both sides of the excavated underground space at the lower parts of said supporting members, and struts are placed on the main structure such that said struts are fixed to said supporting members disposed at both sides of the excavated underground space.

9. The system as defined in claim 1, wherein said supporting members are wales disposed at both sides of the excavated underground space in the longitudinal direction, said tendon support members comprise two of first tendon supports disposed at the middle part of each of said wales in the longitudinal direction and second tendon supports attached to said wales at both sides of said first tendon supports such that the height of said second tendon supports are lower than that of said first tendon supports, said tensioning members are placed on said tendon support members so that said wales are pre-stressed, said struts are disposed at regular intervals in the longitudinal direction of said wales in pairs such that said struts are attached to said wales, the pairs of said struts being braced.

10. The system as defined in claim 9, wherein a plurality of vertical piles extended in the vertical direction of the excavated underground space are disposed at said wales at regular intervals, said tendon support members and said tensioning members are respectively attached to said vertical piles so as to be pre-stressed at a region directly subjected to the earth pressure in the longitudinal direction.

11. The system as defined in claim 1, wherein said supporting members comprise a plurality of first vertical piles arranged at regular intervals in the longitudinal direction and extended in the vertical direction of the excavated underground space, and second vertical piles disposed at both sides of the excavated underground space and extended in the vertical direction of the excavated underground space;

said tendon support members and said tensioning members are disposed at the lower parts of said first and second vertical piles so that the lower parts of said first and second vertical piles are pre-stressed;

a plurality of wales are disposed at the upper and lower parts of said first vertical piles so that said first vertical piles are attached to said wales;

said tendon support members and said tensioning members are disposed at said wales so that said wales are pre-stressed;

the upper ends of said second vertical piles disposed at both sides of the excavated underground space are connected to each other by means of main girders;

cover plates are placed on said main girders;

said tendon support members and said tensioning members are disposed at said wales so that said wales are pre-stressed;

said second vertical piles disposed at both sides of the excavated underground space are connected to each other by means of a plurality of struts; and the main structure is built in the space between said first and second vertical piles.

12. The system as defined in claim 1, comprising the steps of:

disposing vertical piles at both sides of the excavated underground space in the longitudinal direction after the ground is excavated to a prescribed depth;

pre-stressing main girders by means of tendon support members and tensioning members;

disposing the main girders at the upper ends of said vertical piles disposed at both sides of the excavated underground space such that said main girders are connected to said vertical piles;

pre-stressing wales by means of tendon support members and tensioning members;

disposing said wales at said vertical piles such that said wales are connected to said vertical piles arranged in the longitudinal direction;

fixing struts to the lower parts of said vertical piles; and pre-stressing the lower parts of said vertical piles by means of tendon support members and tensioning members.

13. The system as defined in claim 1, wherein said tendon support members are trusses fixed to said supporting members in the longitudinal direction so that said tensioning members are laid on the trusses while said tensioning members are supported by means of said trusses.

14. The system as defined in claim 13, wherein each of the trusses has a long side, a short side, and first and second oblique sides connecting the long and short sides, the long and short sides and the first and second oblique sides together forming a trapezoidal shape, so that one end of said tensioning member is fixed to one surface of the long side of said truss, passes through the first oblique side and the short side of said truss, and is fixed to the other surface of the long side of said truss via the second oblique side of said truss.

15. The system as defined in claim 13, wherein each said trusses has a long side, a short side, and first and second oblique sides connecting the long and short sides, the long and short sides and the first and second oblique sides together forming a trapezoidal shape, so that one end of said tensioning member is fixed to one surface of the long side of said truss, is extended to the middle part of the short side of said truss and fixed to the short side, and is fixed to the other surface of the long side of said truss.

16. The system as defined in claim 13, wherein each of said trusses has a long side, a short side, and first and second oblique sides connecting the long and short sides, the long and short sides and the first and second oblique sides together forming a trapezoidal shape, so that one end of said tensioning member is fixed to one surface of the short side of said truss, is extended in the longitudinal direction of the short side of said truss, and is fixed to the other surface of the short side of said truss.

17. The system as defined in claim 1, wherein both ends of said respective tensioning members are fixed by means of anchoring units attached to said supporting members.

18. The system as defined in claim 1, wherein each of said tendon supports has a tendon base formed at the upper end thereof, said tendon base having a curved tendon guide.

19. The system as defined in claim 1, wherein each of said tendon supports has a thread part and a height-adjusting knob so that the height of said tendon support can be adjusted by means of said thread part and said height-adjusting knob.

20. The system as defined in claim 18, wherein said tendon base is extended in the
lateral direction so that said tendon base does not make contact with said support beams, said second and the third tendon supports being fixed to said supporting members by means of "L"-shaped bolts.

21. The system as defined in claim 18, wherein said tendon base is disposed at both sides of said supporting members so that said tendon base does not make contact with said support beams, said second and the third tendon supports being fixed to said supporting members by means of "L"-shaped bolts.

22. The system as defined in claim 17, wherein said anchoring units are attached to the upper surfaces of said supporting members, and wherein each of said anchoring units comprises gusset plates disposed between flanges of said supporting members, a tendon support plate attached to one side of said flanges, and an anchoring steel plate and a supporting steel plate connected to said tensioning member.

23. The system as defined in claim 17, wherein said anchoring units are attached to the side surfaces of said supporting members, and wherein each of said anchoring units comprises gusset plates disposed between flanges of said supporting members, and a tendon support plate attached to said reinforcing steel plate, said tensioning member being fixed to said tendon support plate.

24. The system as defined in claim 1, wherein said supporting members are supported by means of jack supports mounted to a floor slab, said floor slab being a part of the main structure.

25. The system as defined in claim 1, wherein "["-shaped channels are inserted between said flanges of said supporting members for reinforcing said supporting members.

* * * * *